US009034550B2

(12) United States Patent
Mizoguchi et al.

(10) Patent No.: US 9,034,550 B2
(45) Date of Patent: May 19, 2015

(54) TONER, DEVELOPER, IMAGE FORMING APPARATUS, AND IMAGE FORMING METHOD

(75) Inventors: Yuka Mizoguchi, Shizuoka (JP); Hideki Sugiura, Shizuoka (JP); Azumi Miyaake, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/988,600

(22) PCT Filed: Nov. 2, 2011

(86) PCT No.: PCT/JP2011/075879

§ 371 (c)(1),
(2), (4) Date: May 21, 2013

(87) PCT Pub. No.: WO2012/070389

PCT Pub. Date: May 31, 2012

(65) Prior Publication Data

US 2013/0236828 A1 Sep. 12, 2013

(30) Foreign Application Priority Data

Nov. 22, 2010 (JP) ..... 2010-260599
Oct. 19, 2011 (JP) ..... 2011-229624

(51) Int. Cl.
*G03G 9/093* (2006.01)
*G03G 9/087* (2006.01)
*G03G 15/20* (2006.01)

(52) U.S. Cl.
CPC ..... *G03G 9/093* (2013.01); *G03G 9/08755* (2013.01); *G03G 9/08797* (2013.01); *G03G 9/09328* (2013.01); *G03G 9/09371* (2013.01); *G03G 9/09392* (2013.01); *G03G 15/2064* (2013.01)

(58) Field of Classification Search
CPC ..... G03G 9/09371; G03G 9/09392
USPC ..... 430/110.2, 109.4, 123.5, 124.3; 399/252
See application file for complete search history.

(56) References Cited

U.S. PATENT DOCUMENTS

| | | | | |
|---|---|---|---|---|
| 2,297,691 | A | 10/1942 | Carlson | |
| 7,166,403 | B2 | 1/2007 | Ichikawa et al. | |
| 7,261,989 | B2 | 8/2007 | Sugiura et al. | |
| 7,318,989 | B2 | 1/2008 | Kotsugai et al. | |
| 7,374,851 | B2 | 5/2008 | Nakayama et al. | |
| 7,405,000 | B2 | 7/2008 | Takikawa et al. | |
| 7,455,942 | B2 | 11/2008 | Nagatomo et al. | |
| 7,664,439 | B2 | 2/2010 | Sugiura | |
| 7,745,084 | B2 | 6/2010 | Sugiura et al. | |
| 7,759,036 | B2 | 7/2010 | Utsumi et al. | |
| 8,007,976 | B2 | 8/2011 | Sugiura et al. | |
| 8,043,780 | B2 | 10/2011 | Sugiura et al. | |
| 2004/0105693 | A1 | 6/2004 | Akizuki et al. | |
| 2005/0208411 | A1 | 9/2005 | Nakayama et al. | |
| 2006/0045571 | A1* | 3/2006 | Matsuura et al. | 399/149 |
| 2006/0057488 | A1 | 3/2006 | Inoue et al. | |
| 2007/0059063 | A1 | 3/2007 | Nakayama et al. | |
| 2008/0014527 | A1 | 1/2008 | Kotsugai et al. | |
| 2008/0268366 | A1 | 10/2008 | Nakayama et al. | |
| 2009/0220883 | A1 | 9/2009 | Sugiura | |
| 2011/0003244 | A1 | 1/2011 | Inoue et al. | |
| 2011/0097659 | A1 | 4/2011 | Sugiura et al. | |
| 2011/0281209 | A1* | 11/2011 | Sugiura et al. | 430/105 |

FOREIGN PATENT DOCUMENTS

| | | |
|---|---|---|
| CN | 1504840 | 6/2004 |
| JP | 05-333583 | 12/1993 |
| JP | 2004-085850 | 3/2004 |
| JP | 2005-091869 | 4/2005 |
| JP | 2005-301261 | 10/2005 |
| JP | 3747928 | 12/2005 |
| JP | 2006-010960 | 1/2006 |
| JP | 2006-276307 | 10/2006 |
| JP | 2007-086211 | 4/2007 |
| JP | 2007-233169 | 9/2007 |
| JP | 4033096 | 11/2007 |
| JP | 2007-322953 | 12/2007 |
| JP | 4347174 | 10/2009 |
| JP | 2010-044354 | 2/2010 |
| JP | 2010-175933 | 8/2010 |

OTHER PUBLICATIONS

International Search Report Issued Dec. 13, 2011 in PCT/JP2011/075879 Filed Nov. 2, 2011.
Office Action issued Feb. 16, 2015 in Chinese Patent Application No. 201180065654.7 (with English translation).

* cited by examiner

*Primary Examiner* — Janis L Dote
(74) *Attorney, Agent, or Firm* — Oblon, McClelland, Maier & Neustadt, L.L.P.

(57) ABSTRACT

A toner including a binder resin and a colorant, the toner having a core-shell structure containing a core and a shell, wherein the binder resin contains a crystalline polyester resin and a non-crystalline polyester resin, wherein a ratio (A/B) of a mass (A) of the crystalline polyester resin to a mass (B) of the non-crystalline polyester resin is 5/95 to 75/25, and wherein a ratio (Ds/Dc) of a hardness (Ds) of the shell to hardness (Dc) of the core is 1.05 to 1.50 where the hardnesses (Ds) and (Dc) are measured with a scanning probe microscope.

17 Claims, 4 Drawing Sheets

TONER, DEVELOPER, IMAGE FORMING APPARATUS, AND IMAGE FORMING METHOD

TECHNICAL FIELD

The present invention relates to a toner, a developer, an image forming apparatus and an image forming method.

BACKGROUND ART

Image formation by the electrophotographic method is generally performed through a process including: forming an electrostatic image on a photoconductor (latent electrostatic image bearing member); developing the electrostatic image with a developer to form a visible image (toner image); transferring the visible image onto a recording medium such as paper; and fixing the transferred image on the recording medium to form a fixed image (see, for example, PTL 1).

In recent years, from the viewpoint of saving energy, development has been made on technology capable of forming a toner having lower fixing temperature. For example, there have been proposed toners containing a low-softening-point resin, wax, etc. excellent in low-temperature fixability.

Also, there have been proposed capsule toners composed of a hard shell and a core softened at low temperatures. These capsule toners are excellent in low-temperature fixability but are poor in durability, and thus have not used practically. In view of this, there have recently been proposed toners containing a crystalline resin (e.g., a crystalline polyester) having a sharp response to heat, instead of the capsule toners composed of a hard shell and a core softened at low temperatures (see, for example, PTLs 2 and 3).

By improving toners in low-temperature fixability, there can surely be produced toners that respond to fixing at low temperatures. However, the toners excellent in low-temperature fixability tend to involve blocking phenomenon in which the toners are hardened due to, for example, heat generated from the apparatus or during storage, resulting in that they are problematically poor in heat resistant storage stability.

In addition, there are concerns that the toners are pulverized by stress such as stirring in the developing device to cause toner spent and/or filming on the developing member, carrier, etc. In order to overcome such failures and incorporate a crystalline polyester into the toner in a certain amount or more, the toners have to be encapsulated. However, the core containing a crystalline polyester in a certain amount or more is soft. Thus, the capsule toner obtained by encapsulating such a soft core with a shell has a problem in that it is poor in durability similar to the aforementioned capsule toners composed of a hard shell and a soft core.

In order for the toner to be excellent in all of low-temperature fixability, heat resistant storage stability and developing stability, there has been a toner in which the amount of deformation at pressing with 1 mN is 1.0 μm to 3.0 μm and the amount of deformation at pressing with 5 mN is 3.0 μm to 5.0 μm, which are measured by a deformation evaluation method, and the surface roughness Ra is 0.02 μm to 0.40 μm as measured by a Ra evaluation method (see PTL 4).

However, although this proposed toner is excellent in low-temperature fixability and heat resistant storage stability, it is not satisfactory in durability to stress in the developing device such as stirring, which is problematic.

In view of the above, demand has arisen for a toner excellent in low-temperature fixability and heat resistant storage stability as well as having sufficient durability to stress in the developing device such as stirring; and a developer, an image forming apparatus and an image forming method each using the toner.

CITATION LIST

Patent Literature

PTL 1 U.S. Pat. No. 2,297,691
PTL 2 Japanese Patent (JP-B) No. 4347174
PTL 3 Japanese Patent Application Laid-Open (JP-A) No. 2007-233169
PTL 4 JP-A No. 2010-175933

SUMMARY OF INVENTION

Technical Problem

The present invention aims to solve the problems pertinent in the art and achieve the following objects. Specifically, an object of the present invention is to provide a toner excellent in low-temperature fixability and heat resistant storage stability as well as having sufficient durability to stress in the developing device such as stirring; and a developer, an image forming apparatus and an image forming method each using the toner.

Solution to Problem

Means for solving the above problems are as follows.

<1> A toner including:

a binder resin; and a colorant, the toner having a core-shell structure containing a core and a shell, wherein the binder resin contains a crystalline polyester resin and a non-crystalline polyester resin, wherein a ratio (A/B) of a mass of the crystalline polyester resin (A) to a mass of the non-crystalline polyester resin (B) is 5/95 to 75/25, and wherein a ratio (Ds/Dc) of a hardness (Ds) of the shell to a hardness (Dc) of the core is 1.05 to 1.50 where the hardnesses (Ds) and (Dc) are measured with a scanning probe microscope.

<2> The toner according to <1>, wherein the shell has an average thickness of 0.01 μm to 0.5 μm.

<3> The toner according to <1> or <2>, wherein the ratio (Ds/Dc) is 1.05 to 1.15.

<4> The toner according to any one of <1> to <3>, wherein a ratio Mw/Mn is 5.0 or less where Mw denotes a weight average molecular weight of the crystalline polyester resin (A) and Mn denotes a number average molecular weight of the crystalline polyester resin (A).

<5> The toner according to any one of <1> to <4>, wherein the toner is obtained through granulation performed by dispersing, in an aqueous medium, an oil phase containing at least the crystalline polyester resin, the non-crystalline polyester resin and the colorant.

<6> The toner according to <5>, wherein the granulation in the aqueous medium is performed through a process including:

dispersing or dissolving, in an organic solvent, at least an active hydrogen group-containing compound, a polyester resin having a functional group reactive with the active hydrogen group-containing compound, the crystalline polyester resin, the non-crystalline polyester resin and the colorant, to thereby prepare a dissolved or dispersed product;

dispersing the dissolved or dispersed product in the aqueous medium containing fine resin particles, to thereby prepare a first dispersion liquid;

allowing, in the first dispersion liquid, the active hydrogen group-containing compound and the polyester resin having a functional group reactive with the active hydrogen group-containing compound to undergo crosslinking reaction or elongating reaction or both of the crosslinking reaction and the elongating reaction in the presence of the fine resin particles, to thereby prepare a second dispersion liquid; and removing the organic solvent from the second dispersion liquid.

<7> A developer including:

the toner according to any one of <1> to <6>.

<8> An image forming apparatus including:

a latent electrostatic image bearing member;

a latent electrostatic image forming unit configured to form a latent electrostatic image on the latent electrostatic image bearing member;

a developing unit configured to develop the latent electrostatic image with a toner to form a visible image;

a transfer unit configured to transfer the visible image onto a recording medium; and a fixing unit configured to fix the transferred visible image on the recording medium, wherein the toner is the toner according to any one of <1> to <6>.

<9> The image forming apparatus according to <8>, further including a process cartridge detachably mounted to a main body of the image forming apparatus, wherein the process cartridge integrally supports the latent electrostatic image bearing member and at least the developing unit.

<10> An image forming method including:

forming a latent electrostatic image on a latent electrostatic image bearing member;

developing the latent electrostatic image with a toner to form a visible image;

transferring the visible image onto a recording medium; and fixing the transferred visible image on the recording medium, wherein the toner is the toner according to any one of <1> to <6>.

<11> The image forming method according to <10>, wherein the fixing is heating and fixing the transferred visible image on the recording medium with a heat generator, one or more heat transfer media heated by the heat generator, and a press member for pressing the recording medium against one of the heat transfer media, and wherein at least one of the heat transfer media is a belt-shaped heat transfer medium and the belt-shaped heat transfer medium is used with a certain amount of oil applied on a surface thereof or with no oil applied on the surface thereof.

<12> The image forming method according to <10> or <11>, wherein a surface pressure in the fixing is 10 $N/cm^2$ to 80 $N/cm^2$.

Advantageous Effects of Invention

The present invention can provide a toner excellent in low-temperature fixability and heat resistant storage stability as well as having sufficient durability to stress in the developing device such as stirring; and a developer, an image forming apparatus and an image forming method each using the toner. These can solve the above problems pertinent in the art.

DESCRIPTION OF EMBODIMENTS

Toner

A toner of the present invention has a core-shell structure containing a core and a shell.

The toner contains at least a binder resin and a colorant; and, if necessary, further contains other ingredients.

The ratio (Ds/Dc) of a hardness (Ds) of the shell to a hardness (Dc) of the core is 1.05 to 1.50, where the hardnesses (Ds) and (Dc) are measured with a scanning probe microscope (SPM).

The binder resin contains a crystalline polyester resin and a non-crystalline polyester resin.

The ratio (A/B) of the mass of the crystalline polyester resin (A) to the mass of the non-crystalline polyester resin (B) (mass ratio) is 5/95 to 75/25.

<Ratio (Ds/Dc)>

By adjusting the ratio (Ds/Dc) to fall within a range of 1.05 to 1.50, the formed toner can have resistance to stress in the developing device; i.e., high durability. When the ratio (Ds/Dc) is less than 1.05, external additives are embedded in the surface of the shell due to stress applied over time and carrier spent occurs as a result of, for example, beating the toner, making it difficult to maintain good transferability and chargeability. When it is greater than 1.50, the formed toner is good in durability but is too hard. As a result, the toner is decreased in holdability of external additives, so that it is degraded in charge holdability, flowability and melting property, which leads to a failure in expansion upon fixing.

The ratio (Ds/Dc) is preferably 1.05 to 1.15. When it is in the preferred range, the formed toner can maintain stable low-temperature fixability and durability.

The hardnesses of the core and the shell can be controlled by, for example, controlling the binder resin in terms of the molecular structure causing steric hindrance (e.g., aromatic ring), the crosslinking degree and the molecular weight and controlling the ratio of the mass of the crystalline polyester resin and the mass of the non-crystalline polyester resin.

—Method for Measuring Hardness (Dc) of Core and Hardness (Ds) of Shell—

The measurement of the hardness (Dc) of the core and the hardness (Ds) of the shell with SPM (Scanning Probe Microscope) is preferably performed with the below-described method. Other means may be used so long as these hardnesses can be measured therewith.

First, the toner is embedded in an epoxy resin, followed by hardening. The hardened product is cut with an ultramicrotome (product of Leica Co., ULTRACUT UCT, using a diamond knife) to form a cross-section of the toner.

In general, the core and the shell of the toner can be discriminated from each other through observation with the SPM. When it is difficult to discriminate them from each other, a sample for observation under TEM (transmission electron microscope) is prepared in addition to the cross-sectional sample for observation under SPM, and the sample may be observed under TEM to discriminate them from each other. Other means may be used so long as the core and the shell can be discriminated from each other.

Figure 2:
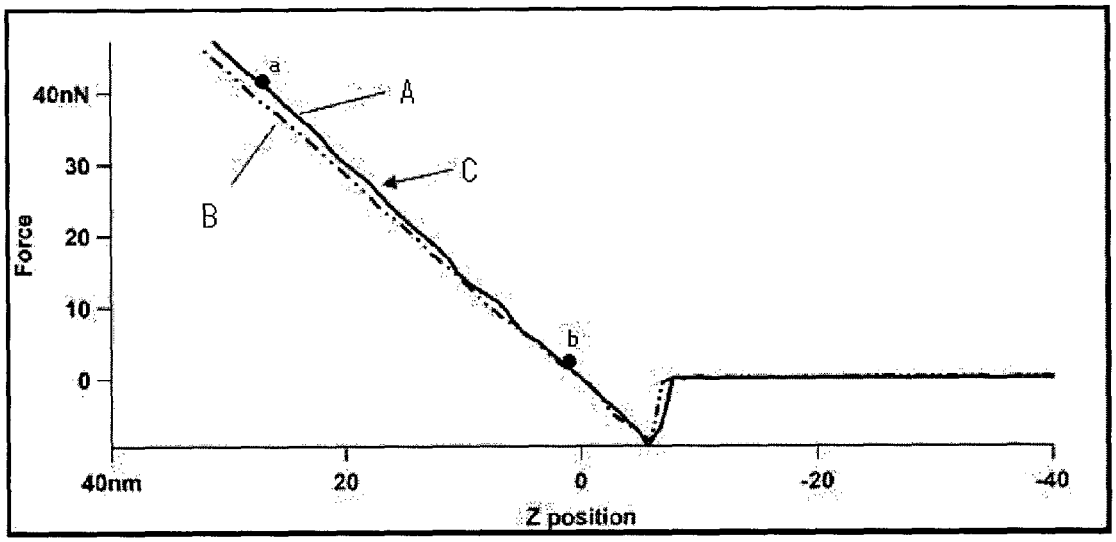
FIG. 2 is an exemplary chart of hardenesses of a toner measured with a scanning probe microscope (SPM).

Thereafter, the core and the shell of the toner are measured for force curve with SPM. To obtain an accurate force curve in the measurement, the gradient of the baseline is corrected and the spring constant is calibrated. The measurement results are shown in FIG. 2. In the force curve, the horizontal axis indicates the movement of the piezo along the Z axis and the vertical axis indicates force. In the force curve obtained when the cantilever approaches the sample, "b" denotes a point where the cantilever comes into contact with the surface of the sample as a result of elongation of the Z piezo, and "a" denotes a point which is immediately before the cantilever starts to return at the trigger point after pressing down the sample. Here, the gradient of the line connecting the two points with each other (i.e., the gradient of the line segment a-b denoted by C in FIG. 2) is used as the index of the hardness.

Here, when the sample is harder, the force is greater to give a greater gradient (as shown in the line denoted by A in FIG. 2); while the sample is softer, the force is smaller to give a smaller gradient (as shown in the line denoted by B in FIG. 2).

In the measurement of the force curve, 20 points or greater are measured so as to secure a sufficient number of "n." The average of the measured gradients (nN/nm) is used as a measurement result.

The measurement conditions are as follows.

SPM apparatus: model MFP-3D molecular force probe microscope system (product of Asylum Co.)

Measurement mode: force curve measurement (contact mode, closed loop)

Trigger point: Deflection voltage: 0.30 V to 0.35 V

Cantilever: AC240TS-C2 (spring constant: about 2 N/m)

<Mass Ratio (A/B)>

The crystalline polyester resin has crystallinity and thus, has a heat melt profile where it is steeply decreased in viscosity near the melting point thereof. That is, the crystalline polyester resin is in a solid state immediately before the initiation of melting and thus is excellent in heat resistant storage stability, while the crystalline polyester resin is steeply decreased in viscosity at the initiation temperature of melting upon fixing. Therefore, use of the crystalline polyester resin can design a toner excellent in both heat resistant storage stability and low-temperature fixability. In order for the toner to have more excellent low-temperature fixability, it is necessary for the mass ratio (A/B) of the crystalline polyester resin (A) to the non-crystalline polyester resin (B) in the toner to be 5/95 to 75/25. When the mass of the crystalline polyester resin is less than the lower limit of the above mass ratio, the requirement of low-temperature fixability cannot sufficiently be satisfied. Whereas when the mass of the crystalline polyester resin is more than the upper limit of the above mass ratio, there are concerns that durability and chargeability will be impaired. For obtaining the low-temperature fixability, the mass ratio (A/B) is preferably 20/80 to 75/25.

<Core and Shell>

—Core—

The core is not particularly limited and may be appropriately selected depending on the intended purpose. Examples of the core include a core containing at least a binder resin and a colorant; and, if necessary, further containing other ingredients.

—Shell—

The shell is not particularly limited and may be appropriately selected depending on the intended purpose. Examples of the shell include a shell containing at least a binder resin; and, if necessary, further containing other ingredients.

The thickness of the shell is not particularly limited and may be appropriately selected depending on the intended purpose. It is preferably 0.01 μm to 0.5 μm. When the average thickness of the shell is controlled to be 0.5 μm or smaller, it is possible to maintain satisfactory durability without degrading the low-temperature fixability. Whereas when the average thickness of the shell is controlled to be larger than 0.5 μm, the low-temperature fixability may be degraded. Moreover, when the core contains the releasing agent, the releasing agent is prevented from exuding, resulting in that the toner may be degraded in releaseability upon fixing.

The average thickness of the shell is preferably measured by the below-described method. Other means may be used so long as it can be measured. The average thickness of the shell is measured by measuring the thicknesses of the shells of randomly selected 10 particles and averaging the measured thicknesses.

1) Measurement with TEM (Transmission Electron Microscope)

The toner is embedded in an epoxy resin, followed by hardening. The hardened product is cut with an ultramicrotome (product of Leica Co., ULTRACUT UCT, using a diamond knife) to prepare an ultra-thin section of the toner (thickness: 70 nm). The thus-prepared sample is exposed to gas of ruthenium tetroxide for 2 min for staining. Subsequently, the sample is observed under TEM (transmission electron microscope; product of JEOL Co., JEM-2100) at an acceleration voltage of 100 kV.

2) Measurement with FE-SEM (Scanning Electron Microscope)

The toner is embedded in an epoxy resin, followed by hardening. The hardened product is cut with an ultramicrotome (product of Leica Co., ULTRACUT UCT, using a diamond knife) to form a cross-section of the toner. The thus-prepared sample is exposed to gas of ruthenium tetroxide for 2 min for staining. Subsequently, a reflection electron image of the sample is observed under FE-SEM (scanning electron microscope; product of Zeiss Co., ULTRA55) at an acceleration voltage of 0.8 kV.

3) Measurement with SPM

The toner is embedded in an epoxy resin, followed by hardening. The hardened product is cut with an ultramicrotome (product of Leica Co., ULTRACUT UCT, using a diamond knife) to form a cross-section of the toner. Subsequently, SPM (model MFP-3D molecular force probe microscope system (product of Asylum Co.)) is used at the tapping mode to obtain a phase image, which is then used to observe a layer image based on the difference in viscoelasticity and adhesiveness.

The core is preferably different in composition from the shell, since the core and the shell can effectively exhibit their individual functions. For example, when the core is different in composition from the shell, the shell can contribute to maintaining the heat resistant storage stability and anti-fouling property while the core can contribute to appropriately dispersing the colorant, etc. and low-temperature fixabiltiy. In this manner, the shell and the core can effectively exhibit their individual functions. This is also preferred since the toner can be designed to have separate functions.

<Binder Resin>

Examples of the binder resin include the crystalline polyester resin, the non-crystalline polyester resin and fine resin particles.

—Crystalline Polyester Resin—

The crystalline polyester resin is obtained from a polyhydric alcohol component and a polycarboxylic acid component such as a polycarboxylic acid, a polycarboxylic anhydride or a polycarboxylic acid ester.

Notably, in the present invention, the crystalline polyester resin refers to a product obtained as described above from a polyhydric alcohol component and a polycarboxylic acid component such as a polycarboxylic acid, a polycarboxylic anhydride or a polycarboxylic acid ester; however the crystalline polyester resin does not encompass modified polyester resins such as the below-described polyester prepolymer and modified polyester resin obtained through crosslinking reaction and/or elongating reaction of the polyester prepolymer.

The polyhydric alcohol component is not particularly limited and may be appropriately selected depending on the intended purpose. Examples of the polyhydric alcohol component include saturated aliphatic diol compounds having 2 to 12 carbon atoms. Examples of the saturated aliphatic diol compounds having 2 to 12 carbon atoms include 1,4-butanediol, 1,6-hexanediol, 1,8-octanediol, 1,10-decanediol and 1,12-dodecanediol.

The polycarboxylic acid component is not particularly limited and may be appropriately selected depending on the intended purpose. Examples of the polycarboxylic acid component include dicarboxylic acids having 2 to 12 carbon atoms and a double bond (C=C double bond), saturated dicarboxylic acids having 2 to 12 carbon atoms, and derivatives thereof. Specific examples thereof include fumaric acid, 1,4-butanedioic acid, 1,6-hexanedioic acid, 1,8-ocatnedioic acid, 1,10-decanedioic acid, 1,12-dodecanedioic acid and derivatives thereof.

The method for controlling the crystalline polyester resin in crystallinity and softening point is not particularly limited and may be appropriately selected depending on the intended purpose. Examples thereof include a method by designing and employing a nonlinear polyester.

The synthesis method for the nonlinear polyester is not particularly limited and may be appropriately selected depending on the intended purpose. Examples thereof include a method in which the nonlinear polyester is synthesized by condensation polymerization using the alcohol component to which, further, a trihydric or higher polyhydric alcohol such as glycerin is added and the acid component to which, further, a trivalent or higher polycarboxylic acid such as trimellitic anhydride is added.

The molecular structure of the crystalline polyester resin can be confirmed by NMR, for example.

The molecular weight of the crystalline polyester resin is not particularly limited and may be appropriately selected depending on the intended purpose. The crystalline polyester resin having a sharp molecular weight distribution and having a low molecular weight is preferred from the viewpoint of being excellent in achieving low-temperature fixability. The following crystalline polyester resin is more preferred: in terms of molecular weight distribution by gel permeation chromatography (GPC) using o-dichlorobenzene soluble content, a peak is located in a range of 3.5 to 4.0, and the half width of the peak is 1.5 or less in the molecular weight distribution plot with a horizontal axis representing log (M) and a vertical axis representing % by mass; and the weight average molecular weight (Mw) is 1,000 to 6,500, the number average molecular weight (Mn) is 500 to 2,000, and a ratio Mw/Mn of 2 to 5.

The gel permeation chromatography (GPC) for determining the molecular weight can be performed, for example, as follows.

Specifically, a column is conditioned in a heat chamber at 40° C., and then tetrahydrofuran (THF) (solvent) is caused to pass through the column at a flow rate of 1 mL/min while the temperature is maintained. Subsequently, a separately prepared tetrahydrofuran solution of a resin sample (concentration; 0.05% by mass to 0.6% by mass) is applied to the column in an amount of 50 μL to 200 μL. In the measurement of the molecular weight of the sample, the molecular weight distribution is determined based on the relationship between the logarithmic value and the count number of a calibration curve given by using several monodisperse polystyrene-standard samples. The standard polystyrenes used for giving the calibration curve may be, for example, those available from Pressure Chemical Co. or Tosoh Co.; i.e., those each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$. Preferably, at least about 10 standard polystyrenes are used for giving the calibration curve. The detector which can be used is a refractive index (R1) detector.

The ratio (Mw/Mn) of the weight average molecular weight (Mw) to the number average molecular weight (Mn) is not particularly limited and may be appropriately selected depending on the intended purpose. It is preferably 5.0 or less. By controlling the ratio (Mw/Mn) to be 5.0 or less, the crystalline polyester resin (A) has a sharper molecular weight distribution. Thus, the crystalline polyester resin (A) and the non-crystalline polyester resin (B) can be prevented from being in a partially compatible state. When the ratio (Mw/Mn) is more than 5.0, the crystalline polyester resin (A) has a broader molecular weight distribution. In this case, part of the crystalline polyester resin (A) having lower molecular weights becomes in a partially compatible state with the non-crystalline polyester resin (B). As a result, there exist disadvantageously soft parts. In this state, there is larger variation in hardness in the interior of the core, potentially degrading durability. The ratio (Mw/Mn) is preferably 4.0 or less. When the ratio (Mw/Mn) is 4.0 or less, the core becomes more uniform in hardness, making it possible to keep durability high. The lower limit of the ratio (Mw/Mn) is not particularly limited and may be appropriately selected depending on the intended purpose. It is preferably 1.0 or more, more preferably 2.0 or more, particularly preferably 3.0 or more.

When the non-crystalline polyester resin is used in combination as well as the ratio by mass of the crystalline polyester resin and the non-crystalline polyester resin and the molecular weight distribution of the crystalline polyester resin are respectively adjusted to fall within specific ranges, it is easier to control the compatible state between the non-crystalline polyester resin and the crystalline polyester resin to adjust a ratio in hardness between the core and the shell to fall within a specific range.

The acid value of the crystalline polyester resin is not particularly limited and may be appropriately selected depending on the intended purpose. It is preferably 5 mgKOH/g or higher, more preferably 10 mgKOH/g or higher for the purpose of achieving the intended low-temperature fixability in view of affinity of the crystalline polyester resin with recording media. On the other hand, it is preferably 45 mgKOH/g or lower from the viewpoint of improving offset resistance.

The acid value can be measured according to the method of JIS K0070-1992 in the following manner. Specifically, a sample solution is titrated with a pre-standardized N/10 potassium hydroxide/alcohol solution and then the acid value is calculated from the amount of the pre-standardized N/10 potassium hydroxide/alcohol solution consumed using the equation:

$$\text{Acid value}=\text{KOH (mL)}\times N\times 56.1/\text{mass of sample},$$

where N is a factor of N/10 KOH.

Also, the hydroxyl value of the crystalline polyester resin is not particularly limited and may be appropriately selected depending on the intended purpose. It is preferably 0 mgKOH/g to 50 mgKOH/g, more preferably 5 mgKOH/g to 50 mgKOH/g, in order to achieve both intended low-temperature fixability and favorable charging property.

The hydroxyl value can be measured according to the method of JIS K0070-1992, for example. Specifically, 0.5 g of a sample is accurately weighed in a 100 mL measuring flask, and then 5 mL of an acetylation reagent is accurately added thereto. Next, the measuring flask is heated in a bath set to 100° C.±5° C. One hour to two hours after, the measuring flask is taken out from the hot water bath and left to cool. In addition, water is added to the measuring flask, which is then shaken to decompose acetic anhydride. Next, for completely decomposing acetic anhydride, the flask is heated again in the bath for 10 min or longer and then left to cool. Thereafter, the wall of the flask is thoroughly washed with an organic solvent. Using electrodes, the OH value of the thus-prepared liquid is measured through potentiometric titration with N/2 ethanol solution of potassium hydroxide (according to the method of K0070-1966).

The melting point of the crystalline polyester resin is not particularly limited and may be appropriately selected depending on the intended purpose. In a differential scanning calorimetry curve obtained through differential scanning calorimetry (DSC), the temperature at which the endothermic peak, where the amount of heat absorbed becomes maximum, is observed (hereinafter the temperature may be referred to as "maximum endothermic peak temperature") is preferably 50° C. to 150° C., more preferably 80° C. to 125° C. When the melting point is lower than 50° C., the obtained toner is degraded in heat resistance storage stability, so that it may be hardened during storage to be poor in flowability. When the melting point exceeds 150° C., the releasing agent cannot be finely dispersed during fixing, resulting in that the releasing agent cannot exhibit its releasing effects on the surface of an image, not preventing staining. As a result, glossiness unevenness and solid image's surface roughness may occur.

The amount of the crystalline polyester resin is not particularly limited and may be appropriately selected depending on the intended purpose. It is preferably 2 parts by mass to 60 parts by mass, more preferably 5 parts by mass to 20 parts by mass, still more preferably 5 parts by mass to 15 parts by mass, per 100 parts by mass of the toner. When it is less than 2 parts by mass, low-temperature fixing property may be degraded as well as glossiness unevenness and solid image's surface roughness may occur. When it exceeds 60 parts by mass, storage stability may be degraded.

The crystalline polyester resin may be contained in any of the core and the shell.

—Non-Crystalline Polyester Resin—

Examples of the non-crystalline polyester resin include unmodified polyester resins and modified polyester resins.

The non-crystalline polyester resin may be contained in any of the core and the shell.

——Unmodified Polyester Resin——

The unmodified polyester resin is a polyester resin having no crystallinity which is obtained from a polyhydric alcohol component and a polycarboxylic acid component such as a polycarboxylic acid, a polycarboxylic anhydride or a polycarboxylic acid ester.

Examples of the polyhydric alcohol component include adducts of bisphenol A with alkylene oxides (having 2 or 3 carbon atoms) (average addition mole number: 1 to 10) such as polyoxypropylene(2.2)-2,2-bis(4-hydroxyphenyl)propane and polyoxyethylene(2.2)-2,2-bis(4-hydroxyphenyl)propane; ethylene glycol, propylene glycol, neopentyl glycol, glycerin, pentaerythritol, trimethylol propane, hydrogenated bisphenol A, sorbitol and adducts of them with alkylene oxides (having 2 or 3 carbon atoms) (average addition mole number: 1 to 10). These may be used alone or in combination.

Examples of the polyhydric carboxylic acid component include dicarboxylic acids such as adipic acid, phthalic acid, isophthalic acid, terephthalic acid, fumaric acid and maleic acid; succinic acid substituted by a C1-C20 alkyl group or a C2-C20 alkenyl group such as dodecenyl succinic acid and octylsuccinic acid; trimellitic acid and pyromellitic acid; anhydrides and alkyl (having 1 to 8 carbon atoms) esters of these acids. These may be used alone or in combination.

The unmodified polyester resin is preferably in an at least partially compatible state with the below-described polyester prepolymer and the resin obtained through crosslinking reaction and/or elongating reaction of the polyester prepolymer. When they are in the partially compatible state, the formed toner can be increased in low-temperature fixability and hot offset resistance. Thus, preferably, the unmodified polyester resin and the below-described prepolymer are similar in their constituent polyhydric alcohol component and their constituent polycarboxylic acid component.

The molecular weight of the unmodified polyester resin is not particularly limited and may be appropriately selected depending on the intended purpose. When the molecular weight is too low, the formed toner may be poor in heat resistance storage stability and durability to stress such as stirring in the developing device. When the molecular weight is too high, the formed toner may be increased in viscoelasticity during melting, resulting in that it may be degraded in low-temperature fixability. Preferably, through GPC, the unmodified polyester resin has a weight average molecular weight (Mw) of 2,500 to 10,000, a number average molecular weight (Mn) of 1,000 to 4,000, and a Mw/Mn of 1.0 to 4.0.

More preferably, the unmodified polyester resin has a weight average molecular weight (Mw) of 3,000 to 6,000, a number average molecular weight (Mn) of 1,500 to 3,000, and a Mw/Mn of 1.0 to 3.5.

The acid value of the unmodified polyester resin is not particularly limited and may be appropriately selected depending on the intended purpose, but is preferably 1 mgKOH/g to 50 mgKOH/g, more preferably 5 mgKOH/g to 30 mgKOH/g. When the acid value thereof is 1 mgKOH/g or higher, it is easy for the toner to be negatively charged. Moreover, the affinity between toner and paper is increased upon fixing of the toner, which improves low-temperature fixability. Whereas when the acid value thereof is higher than 50 mgKOH/g, charge stability of the toner may be degraded, particularly depending on a change in the working environment.

The hydroxyl value of the unmodified polyester resin is not particularly limited and may be appropriately selected depending on the intended purpose, but is preferably 5 mgKOH/g or higher.

The glass transition temperature (Tg) of the unmodified polyester resin is not particularly limited and may be appropriately selected depending on the intended purpose. When the Tg is too low, the formed toner may be poor in heat resistance storage stability and durability to stress due to, for example, stirring in the developing device. When the Tg is too high, the formed toner may be increased in viscoelasticity during melting, resulting in that it may be degraded in low-temperature fixability. Thus, the Tg is preferably 40° C. to 70° C., more preferably 45° C. to 60° C.

The amount of the unmodified polyester resin is not particularly limited and may be appropriately selected depending on the intended purpose, but is preferably 50 parts by mass to 95 parts by mass, more preferably 60 parts by mass to 90 parts by mass, per 100 parts by mass of the toner. When it is less than 50 parts by mass, the colorant and the releasing agent are degraded in dispersibility in the toner, easily causing image fogging and image failure. When it is more than 95 parts by mass, the formed toner may be degraded in low-temperature fixability since the amount of the crystalline polyester resin becomes small. When it falls within the above more preferred range, the formed toner is excellent in any of image quality, stability and low-temperature fixability, which is advantageous.

——Modified Polyester Resin——

The modified polyester resin is not particularly limited and may be appropriately selected depending on the intended purpose. The modified polyester resin is preferably those containing an active hydrogen group-containing compound and a polyester resin having a functional group reactive with the active hydrogen group of the active hydrogen group-containing compound.

——Active Hydrogen Group-Containing Compound——

The active hydrogen group-containing compound acts, in an aqueous medium, as an elongation agent or crosslinking agent at the time of elongation reaction or crosslinking reaction of the polyester resin containing a functional group reactive with the active hydrogen group-containing compound.

The active hydrogen group-containing compound is not particularly limited, so long as it contains an active hydrogen group, and may be appropriately selected depending on the intended purpose. For example, in cases where the polyester resin containing a functional group reactive with the active hydrogen group-containing compound is an isocyanate group-containing polyester prepolymer (A), amines (B) are preferable from the viewpoint of ability to increase molecular weight by the elongation reaction or crosslinking reaction with the isocyanate group-containing polyester prepolymer (A).

The active hydrogen group is not particularly limited and may be appropriately selected depending on the intended purpose. Examples thereof include hydroxyl group such as an alcoholic hydroxyl group and phenolic hydroxyl group, amino group, carboxyl group and mercapto group. These may be used alone or in combination.

The amines (B) are not particularly limited and may be appropriately selected depending on the intended purpose. Examples thereof include diamines (B1), trivalent or higher polyamines (B2), amino alcohols (B3), amino mercaptans (B4), amino acids (B5), and compounds (B6) obtained by blocking the amino groups of (B1) to (B5). These may be used alone or in combination.

Among them, preference is given to the diamines (B1), and mixtures containing any of the diamines (B1) and a small amount of any of the trivalent or higher polyamines (B2).

The diamines (B1) are not particularly limited and may be appropriately selected depending on the intended purpose. Examples thereof include aromatic diamines, alicyclic diamines and aliphatic diamines. Examples of the aromatic diamines include phenylenediamine, diethyltoluenediamine and 4,4'-diaminodiphenylmethane. Examples of the alicyclic diamines include 4,4'-diamino-3,3'-dimethyldicyclohexylmethane, diaminecyclohexane and isophoronediamine. Examples of the aliphatic diamines include ethylenediamine, tetramethylenediamine and hexamethylenediamine.

The trivalent or higher polyamines (B2) are not particularly limited and may be appropriately selected depending on the intended purpose. Examples thereof include diethylenetriamine and triethylenetetramine.

The amino alcohols (B3) are not particularly limited and may be appropriately selected depending on the intended purpose. Examples thereof include ethanolamine and hydroxyethylaniline.

The amino mercaptans (B4) are not particularly limited and may be appropriately selected depending on the intended purpose. Examples thereof include aminoethyl mercaptan and aminopropyl mercaptan.

The amino acids (B5) are not particularly limited and may be appropriately selected depending on the intended purpose. Examples thereof include aminopropionic acid and aminocaproic acid.

The compounds (B6) obtained by blocking the amino groups of (B1) to (B5) are not particularly limited and may be appropriately selected depending on the intended purpose. Examples thereof include oxazoline compounds and ketimine compounds derived from the amines of (B1) to (B5) and ketones (e.g., acetone, methy ethyl ketone and methyl isobutyl ketone).

——Polyester Resin Containing Functional Group Reactive with Active Hydrogen Group-Containing Compound——

The polyester resin containing a functional group reactive with the active hydrogen group-containing compound (hereinafter may be referred to as "polyester prepolymer (A)") is not particularly limited and may be appropriately selected depending on the intended purpose, so long as it is a polyester resin containing at least a site reactive with the active hydrogen group-containing compound.

The functional group reactive with the active hydrogen group in the polyester prepolymer (A) is not particularly limited and may be appropriately selected from known substituents. Examples thereof include an isocyanate group, an epoxy group, a carboxyl group and an acid chloride group. These may be used alone or in combination.

Among them, an isocyanate group is particularly preferably used as the functional group reactive with the active hydrogen group-containing compound.

The method for producing the polyester prepolymer (A) containing an isocyanate group is not particularly limited and may be appropriately selected depending on the intended purpose. The method for producing the polyester prepolymer (A) is, for example, the below-described method. Specifically, a polyol (A1) and a polycarboxylic acid (A2) are allowed to react together under heating to 150° C. to 280° C. in the presence of a known esterification catalyst such as tetrabutoxytitanate or dibutyltinoxide, optionally while the pressure is being reduced as appropriate. Then, water is removed to obtain a polyester having a hydroxyl group. Subsequently, the obtained polyester is reacted with a polyisocyanate (A3) at 40° C. to 140° C.

The polyol (A1) is not particularly limited and may be appropriately selected depending on the intended purpose. Examples thereof include diols, trihydric or higher polyols, and mixtures of diols and trihydric or higher polyols. These may be used alone or in combination. Among them, the polyol is preferably diols and mixtures of diols and a small amount of trihydric or higher polyols.

The diol is not particularly limited and may be appropriately selected depending on the intended purpose. Examples thereof include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide). These may be used alone or in combination.

Among them, the diol is preferably C2-C12 alkylene glycols and adducts of the bisphenols with alkylene oxides (e.g., bisphenol A ethylene oxide 2 mol adduct, bisphenol A propylene oxide 2 mol adduct and bisphenol A propylene oxide 3 mol adduct).

The trihydric or higher polyol is not particularly limited and may be appropriately selected depending on the intended purpose. Examples thereof include polyvalent aliphatic alcohols (e.g., glycerin, trimethylolethane, trimethylolpropane, pentaerythritol and sorbitol); trihydric or higher phenols (e.g., phenol novolak and cresol novolak); and adducts of trihydric or higher polyphenols with alkylene oxides. These may be used alone or in combination.

In the mixture of the diol and the trihydric or higher polyol, the mixing ratio by mass of the diol and the trihydric or higher polyol (diol trihydric or higher polyol) is not particularly limited and may be appropriately selected depending on the intended purpose. It is preferably 100:0.01 to 100:10, more preferably 100:0.01 to 100:1.

The polycarboxylic acid (A2) is not particularly limited and may be appropriately selected depending on the intended purpose. Examples thereof include alkylene dicarboxylic acids (e.g., succinic acid, adipic acid and sebacic acid); alkenylene dicarboxylic acids (e.g., maleic acid and fumaric acid); and aromatic dicarboxylic acids (e.g., terephthalic acid, isophthalic acid and naphthalene dicarboxylic acid). These may be used alone or in combination. Among them, the polycarboxylic acid (A2) is preferably C4-C20 alkenylene dicarboxylic acids and C8-C20 aromatic dicarboxylic acids.

The trihydric or higher polycarboxylic acid is not particularly limited and may be appropriately selected depending on the intended purpose. Examples thereof include C9-C20 aromatic polycarboxylic acid (e.g., trimellitic acid and pyromellitic acid). These may be used alone or in combination.

Notably, instead of the polycarboxylic acid, polycarboxylic anhydrides or lower alkyl esters may be used. The lower alkyl ester is not particularly limited and may be appropriately selected depending on the intended purpose. Examples thereof include methyl ester, ethyl ester and isopropyl ester.

The polyisocyanate (A3) is not particularly limited and may be appropriately selected depending on the intended purpose. Examples thereof include aliphatic polyisocyanates, alicyclic polyisocyanates, aromatic diisocyanates, aromatic aliphatic diisocyanate, isocyanurates, phenol derivatives thereof and blocked products thereof with, for example, oxime and caprolactam.

The aliphatic polyisocyanate is not particularly limited and may be appropriately selected depending on the intended purpose. Examples thereof include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate and tetramethylhexane diisocyanate.

The alicyclic polyisocyanate is not particularly limited and may be appropriately selected depending on the intended purpose. Examples thereof include isophoron diisocyanate and cyclohexylmethane diisocyanate.

The aromatic diisocyanate is not particularly limited and may be appropriately selected depending on the intended purpose. Examples thereof include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate.

The aromatic aliphatic diisocyanate is not particularly limited and may be appropriately selected depending on the intended purpose. Examples thereof include $\alpha,\alpha,\alpha',\alpha'$-tetramethylxylylene diisocyanate.

The isocyanurate is not particularly limited and may be appropriately selected depending on the intended purpose. Examples thereof include tris-isocyanatoalkyl-isocyanurate and triisocyanatoalkyl-isocyanurate.

These may be used alone or in combination.

The isocyanate group-containing polyester prepolymer (A) preferably has, in one molecule thereof, one or more isocyanate groups on average, more preferably 1.2 groups to 5 groups on average, still more preferably 1.5 groups to 4 groups on average.

When the average number of the isocyanate groups is less than one per one molecule, the molecular weight of the modified polyester resin decreases, resulting in that the formed toner may be degraded in hot offset fixing property and storage stability.

The weight average molecular weight (Mw) of the polyester resin having a functional group reactive with the compound having an active hydrogen-containing group can be determined based on the molecular weight distribution obtained by analyzing tetrahydrofuran (THF) soluble matter of the polyester resin through gel permeation chromatography (GPC). It is preferably 1,000 to 30,000, more preferably 1,500 to 15,000. When the weight average molecular weight (Mw) is lower than 1,000, the formed toner may be degraded in heat resistance storage stability; whereas when the Mw is higher than 30,000, the formed toner may be degraded in low-temperature fixing property.

The modified polyester resin can be obtained by reacting the compound having an active hydrogen-containing group (e.g., the above amines (B)), in an aqueous medium, with the polyester resin having a functional group reactive with the compound having an active hydrogen-containing group (e.g., the above polyester prepolymers (A)).

A solvent is optionally used in reacting the amine (B) with the polyisocyanate (A3).

The solvent usable is not particularly limited and may be appropriately selected depending on the intended purpose. Examples thereof include solvents inert with respect to the polyisocyanate. Specific examples include aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide) and ethers (e.g., tetrahydrofuran). These may be used alone or in combination.

The mixing ratio of the amine (B) and the polyester prepolymer (A) having an isocyanate group is preferably 1/3 to 3/1, more preferably 1/2 to 2/1, particularly preferably 1/1.5 to 1.5/1, in terms of the equivalent ratio ([NCO]/[NHx]) of isocyanate group [NCO] in the polyester prepolymer (A) having an isocyanate group to amino group [NHx] in the amine (B).

When the equivalent ratio ([NCO]/[NHx]) is less than 1/3, low-temperature fixing property may be degraded. Whereas when the equivalent ratio ([NCO]/[NHx]) exceeds 3/1, the molecular weight of the modified polyester resin may decrease to roughness the surface of an image.

Also, a reaction terminator can be used for terminating elongation/crosslinking reaction between the compound having an active hydrogen-containing group and the polyester resin having a functional group reactive with the compound having an active hydrogen-containing group.

The reaction terminator is not particularly limited and may be appropriately selected depending on the intended purpose. Examples thereof include monoamines (e.g., diethyl amine, dibutyl amine, butyl amine and lauryl amine) and blocked products thereof (e.g., ketimine compounds). These may be used alone or in combination.

—Fine Resin Particles—

The fine resin particles are not particularly limited and may be appropriately selected depending on the intended purpose. Examples thereof include vinyl resins, polyurethan resins, epoxy resins, polyester resins, polyamide resins, polyimide resins, silicon-containing resins, phenol resins, melamine resins, urea resins, aniline resins, ionomer resins and polycarbonate resins. Among them, from the viewpoint of easily obtaining aqueous dispersoids of the fine spherical resin particles, preferred are vinyl resins, polyurethan resins, epoxy resins, polyester resins and mixtures thereof, and particularly preferred are vinyl resins.

The vinyl resin is a polymer produced through homopolymerization or copolymerization of vinyl monomers. Examples of the vinyl resin include styrene-(meth)acylate resins, styrene-butadiene copolymers, (meth)acrylic acid-acrylate polymers, styrene-acrylonitrile copolymers, styrene-maleic anhydride copolymers and styrene-(meth)acrylic acid copolymers.

Also, the fine resin particles may be a copolymer formed of a monomer having at least two unsaturated groups.

The monomer having at least two unsaturated groups is not particularly limited and may be appropriately selected depending on the intended purpose. Examples thereof include a sodium salt of sulfuric acid ester of methacrylic acid-ethylene oxide adduct ("ELEMINOL RS-30," product of Sanyo Chemical Industries, Ltd.), divinylbenzene and 1,6-hexanediol acrylate.

The fine resin particles are preferably contained in the shell.

The glass transition temperature (Tg) of the fine resin particles is not particularly limited and may be appropriately selected depending on the intended purpose. It is preferably 40° C. to 100° C. When the glass transition temperature (Tg) is lower than 40° C., the formed toner is degraded in storage stability, potentially causing blocking during storage or in the developing device. When the glass transition temperature (Tg) is higher than 100° C., the fine resin particles impairs adhesiveness between the formed toner and recording paper, potentially leading to an increase in minimum fixing temperature.

Here, the glass transition temperature can be measured using TG-DSC system TAS-100 (product of Rigaku Denki Co., Ltd.) in the following manner. First, a sample (about 10 mg) is placed in an aluminum container, which is placed on a holder unit. The holder unit is then set in an electric oven. The sample is heated from room temperature to 150° C. at a temperature increasing rate of 10° C./min, left to stand at 150° C. for 10 min, cooled to room temperature, and left to stand for 10 min. In a nitrogen atmosphere, the sample is heated again to 150° C. at a temperature increasing rate of 10° C./min, to thereby obtain a DSC curve using a differential scanning calorimeter (DSC). Using the obtained DSC curve and the analysis system of TG-DSC system TAS-100, the glass transition temperature (Tg) can be calculated from the tangent point between the base line and the tangential line of the endothermic curve near the glass transition temperature (Tg).

The weight average molecular weight of the fine resin particles is not particularly limited and may be appropriately selected depending on the intended purpose. It is preferably 3,000 to 300,000. When the weight average molecular weight is lower than 3,000, the formed toner is degraded in storage stability, potentially causing blocking during storage or in the developing device. When the weight average molecular weight is higher than 300,000, the fine resin particles impairs adhesiveness between the formed toner and recording paper, potentially being increased in minimum fixing temperature.

The residual rate (amount) of the fine resin particles relative to the toner is not particularly limited and may be appropriately selected depending on the intended purpose. It is preferably 0.5% by mass to 5.0% by mass. When the residual rate is less than 0.5% by mass, the formed toner is degraded in storage stability, potentially causing blocking during storage or in the developing device. In the case where the residual rate is more than 5.0% by mass, when the core contains the releasing agent, the fine resin particles prevent the releasing agent from being exuding, resulting in that the releasing agent cannot exhibit its releasing effects in some cases to lead to the occurrence of offset.

The residual rate of the fine resin particles can be measured as follows. Specifically, a pyrolysis-gas chromatography-mass spectrometry is used to analyze the substance that is derived from the fine resin particles but is not derived from the toner. Then, the obtained peak areas are used to calculate the residual rate of the fine resin particles. The detector used is preferably a mass spectrometer but is not particularly limited.

The volume average particle diameter of the fine resin particles is preferably 120 nm to 670 nm, more preferably 200 nm to 600 nm. When the volume average particle diameter is less than 120 nm, the thickness of the shell becomes too thin, resulting in that the core-shell structure cannot be formed in some cases. When it is more than 670 nm, the thickness of the shell layer becomes too thick, the formed toner cannot sufficiently exhibit low-temperature fixability.

The volume average particle diameter can be measured by, for example, a particle distribution analyzer (LA-920, product of HORIBA LTD.).

<Colorant>

The colorant is not particularly limited and may be appropriately selected depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone.

The amount of the colorant is not particularly limited and may be appropriately selected depending on the intended purpose. It is preferably 1% by mass to 15% by mass, more preferably 3% by mass to 10% by mass, relative to the toner.

The colorant may be mixed with a resin to form a masterbatch. Examples of the resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required). In this mixing/kneading, a high-shearing disperser (e.g., three-roll mill) is preferably used.

<Other Ingredients>

The other ingredients are not particularly limited and may be appropriately selected depending on the intended purpose. Examples thereof include a releasing agent, a charge controlling agent, an external additive, a flowability improving agent, a cleanability improving agent and a magnetic material.

—Releasing Agent—

The releasing agent is not particularly limited and may be appropriately selected depending on the intended purpose. The below-listed materials can be used as the releasing agent. Examples of waxes include vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum).

Examples of waxes other than the above natural waxes include synthetic hydrocarbon waxes (e.g., Fischer-Tropsch waxes and polyethylene waxes); and synthetic waxes (e.g., ester waxes, ketone waxes and ether waxes).

Further examples include fatty acid amides such as 1,2-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

The melting point of the releasing agent is preferably 50° C. to 120° C., more preferably 60° C. to 90° C. The releasing agent having a melting point of lower than 50° C. may adversely affect the heat resistant storage stability of the formed toner. The releasing agent having a melting point of higher than 120° C. easily causes cold offset upon fixing at low temperatures.

The amount of the releasing agent is not particularly limited and may be appropriately selected depending on the intended purpose. It is preferably 40% by mass or less, more preferably 3% by mass to 30% by mass, relative to the toner.

—Charge Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD); quaternary ammonium salt molybdenum complex TP-302 and TP-415 (these products are of Hodogaya Chemical Co., Ltd.); LRA-901 and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The amount of the charge controlling agent is not particularly limited and may be appropriately selected depending on the intended purpose. It is preferably 0.1 parts by mass to 10 parts by mass, more preferably 0.2 parts by mass to 5 parts by mass, per 100 parts by mass of the toner. When it is more than 10 parts by mass, the formed toner has too high chargeability, resulting in that the charge controlling agent exhibits reduced effects. As a result, the electrostatic force increases between the developing roller and the toner, decreasing the flowability of the toner and forming an image with reduced color density.

These charge controlling agent and release agent may be melt-kneaded together with a masterbatch or resin, and then dissolved or dispersed. Needless to say, they may be added to an organic solvent simultaneously with the masterbatch or binder resin, or may be fixed on the surfaces of the formed toner particles.

—External Additive—

Examples of the external additive include fine oxide particles, fine inorganic particles and hydrophobized fine inorganic particles, which can be used alone or in combination. The average particle diameter of the hydrophobized primary particles of the fine inorganic particles is preferably 1 nm to 100 nm, more preferably 5 nm to 70 nm.

Also, the external additive preferably contains at least one type of the fine inorganic particles in which the hydrophobized primary particles have an average particle diameter of 20 nm or less and at least one type of the fine inorganic particles in which the hydrophobized primary particles have an average particle diameter of 30 nm or more. In addition, the external additive or fine inorganic particles preferably have a specific surface area of 20 $m^2/g$ to 500 $m^2/g$ as measured by the BET method.

The external additive is not particularly limited and may be appropriately selected depending on the intended purpose. Examples thereof include fine silica particles, hydrophobic silica, fatty acid metal salts (e.g., zinc stearate and aluminum starate), metal oxides (e.g., titania, alumina, tin oxide and antimony oxide) and fluoropolymers.

Suitable additives include hydrophobized particles of fine particles of silica, titania, titanium oxide and alumina. Examples of the fine silica particles include R972, R974, RX200, RY200, R202, R805 and R812 (these products are of AEROSIL Japan). Examples of the fine titania particles include P-25 (product of AEROSIL Japan), STT-30, STT-65C-S (these products are of Titan Kogyo, Ltd.), TAF-140 (product of Fuji Titanium Industry Co., Ltd.), MT-150W, MT-500B, MT-600B and MT-150A (these products are of TAYCA Corporation).

Examples of the hydrophobized fine titanium oxide particles include T-805 (product of AEROSIL Japan), STT-30A, STT-65S-S (these products are of Titan Kogyo, Ltd.), TAF-500T, TAF-1500T (these products are of Fuji Titanium Industry Co., Ltd.), MT-100S, MT-100T (these products are of TAYCA Corporation) and IT-S (product of ISHIHARA SANGYO KAISHA, LTD.).

The hydrophobized fine oxide particles, hydrophobized fine silica particles, hydrophobized fine titania particles or hydrophobized fine alumina particles can be obtained by treating hydrophilic fine particles with a silane coupling agent such as methyltrimethoxysilane, methyltriethoxysilane or octyltrimethoxysilane. In addition, preferred are silicone oil-treated fine oxide particles or fine inorganic particles which are obtained by treating fine inorganic particles with silicone oil, if necessary, through application of heat.

Examples of the silicone oil usable include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, (meth)acryl-modified silicone oil and α-methylstyrene-modified silicone oil. Examples of the fine inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride, with silica and titanium dioxide being preferred.

The amount of the external additive is not particularly limited and may be appropriately selected depending on the intended purpose. It is preferably 0.1% by mass to 5% by mass, more preferably 0.3% by mass to 3% by mass, relative to the toner.

The average particle diameter of the primary particles of the fine inorganic particles is not particularly limited and may be appropriately selected depending on the intended purpose. It is preferably 100 nm or less, more preferably 3 nm to 70 nm. When it is less than 3 nm, the fine inorganic particles are embedded in the toner and cannot function effectively. Whereas when it is more than 100 nm, the fine inorganic particles scratch the photoconductor surface, which is not preferred.

—Flowability Improving Agent—

The flowability improving agent is not particularly limited and may be appropriately selected depending on the intended purpose, so long as it can improve hydrophobic properties through surface treatment and prevent the degradation of flowability or chargeability under high humidity environment. Examples of the flowability improving agent include silane coupling agents, silylation agents, silane coupling agents having a fluorinated alkyl group, organotitanate coupling agents, aluminum coupling agents, silicone oils, and modified silicone oils. Particularly preferably, the above silica and titanium oxide are subjected, before use, to surface treatment with such a flowability improving agent, and then are used respectively as hydrophobized silica and hydrophobized titanium oxide.

—Cleanability Improving Agent—

The cleanability improving agent is not particularly limited and may be appropriately selected depending on the intended purpose, so long as it is added to the toner for removing the developer remaining after transfer on the photoconductor and primary transfer medium. Examples of the cleanability improving agent include metal salts of fatty acids such as stearic acid (e.g., zinc stearate and calcium stearate), fine polymer particles formed by soap-free emulsion polymerization, such as fine polymethylmethacrylate particles and fine polystylene particles. The fine polymer particles preferably have a relatively narrow particle size distribution. It is preferable that the volume average particle diameter thereof be 0.01 μm to 1 μm.

—Magnetic Material—

The magnetic material is not particularly limited and may be appropriately selected depending on the intended purpose. Examples thereof include iron powder, magnetite and ferrite. It is preferably white in terms of color tone.

Figure 1:
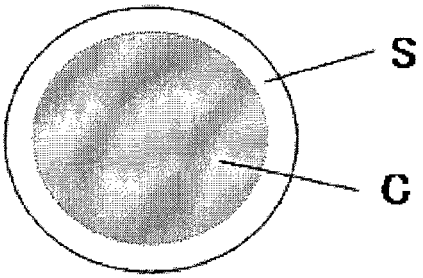
FIG. 1 is a schematic, cross-sectional view of one exemplary toner of the present invention.

FIG. 1 is a schematic view of one exemplary toner of the present invention. In FIG. 1, reference character C denotes a core and S denotes a shell.

<Method for Producing the Toner>

A method for producing the toner is not particularly limited and may be appropriately selected depending on the intended purpose. The toner is preferably granulated by dispersing, in an aqueous medium, an oil phase containing at least the crystalline polyester resin, the non-crystalline polyester resin and the colorant.

The granulation in the aqueous medium is preferably performed through a process including: dispersing or dissolving, in an organic solvent, at least the active hydrogen group-containing compound, a polyester resin having a functional group reactive with the active hydrogen group-containing compound, the crystalline polyester resin, the non-crystalline polyester resin and the colorant, to thereby prepare a dissolved or dispersed mixture; dispersing the dissolved or dispersed mixture, in an aqueous medium, to thereby prepare a first dispersion liquid; allowing, in the aqueous medium, the active hydrogen group-containing compound and the polyester resin having a functional group reactive with the active hydrogen group-containing compound to undergo crosslinking and/or elongating reaction in the presence of the fine resin particles, to thereby prepare a second dispersion liquid (hereinafter the crosslinked or elongated product may be referred to as "adhesive base"); and removing the organic solvent from the second dispersion liquid. This method includes preparing the aqueous medium, preparing the oil phase containing toner materials, emulsifying or dispersing the toner materials, and removing the organic solvent.

—Preparation of Aqueous Medium (Aqueous Phase)—

The preparation of the aqueous medium can be performed by, for example, dispersing the fine resin particles in the aqueous medium. The amount of the fine resin particles added in the aqueous medium is not particularly limited and may be appropriately selected depending on the intended purpose. It is preferably 0.5% by mass to 10% by mass.

The aqueous medium is not particularly limited and may be appropriately selected depending on the intended purpose. Examples thereof include water, water-miscible solvents, and mixtures thereof. These may be used alone or in combination.

Among them, water is preferred.

The water-miscible solvent is not particularly limited and may be appropriately selected depending on the intended purpose. Examples thereof include alcohol, dimethylformamide, tetrahydrofuran, cellosolves and lower ketones. The alcohol is not particularly limited and may be appropriately selected depending on the intended purpose. Examples of the alcohol include methanol, isopropanol and ethylene glycol. The lower ketone is not particularly limited and may be appropriately selected depending on the intended purpose. Examples thereof include acetone and methyl ethyl ketone.

—Preparation of Oil Phase—

The preparation of the oil phase containing the toner materials can be performed by dissolving or dispersing, in the organic solvent, the toner materials containing the active hydrogen group-containing compound, the polyester resin having a functional group reactive with the active hydrogen group-containing compound, the crystalline polyester resin, the non-crystalline polyester resin, the colorant, etc.

The organic solvent is not particularly limited and may be appropriately selected depending on the intended purpose. It is preferably an organic solvent having a boiling point of lower than 150° C. since such an organic solvent can easily be removed.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents may be used alone or in combination.

Among them, preferred are ethyl acetate, toluene, xylene, benzene, methylene chloride, 1,2-dichloroethane, chloroform and carbon tetrachloride and more preferred is ethyl acetate.

—Emulsification or Dispersion—

The emulsifying or dispersing the toner materials can be performed by dispersing, in the aqueous medium, the oil phase containing the toner materials. In the emulsifying or dispersing the toner materials, the active hydrogen group-containing compound and the polyester resin having a functional group reactive with the active hydrogen group-containing compound are allowed to undergo elongating reaction and/or crosslinking reaction, whereby the adhesive base is formed.

The adhesive base may be formed by, for example, any of the following: a method including emulsifying or dispersing, in the aqueous medium, the oil phase containing the polyester resin reactive with the active hydrogen group (e.g., isocyanate group-containing polyester prepolymer) and the active hydrogen group-containing compound (e.g., amines), and allowing, in the aqueous medium, the polyester resin reactive with the active hydrogen group and the active hydrogen group-containing compound to undergo elongating reaction and/or crosslinking reaction; a method including emulsifying or dispersing the oil phase containing the toner materials in the aqueous medium to which the active hydrogen group-containing compound has been added in advance, and allowing, in the aqueous medium, the polyester resin reactive with the active hydrogen group and the active hydrogen group-containing compound to undergo elongating reaction and/or crosslinking reaction; and a method including emulsifying or dispersing the oil phase containing the toner materials in the aqueous medium, adding the active hydrogen group-containing compound to the resultant mixture, and allowing, in the aqueous medium, the polyester resin reactive with the active hydrogen group and the active hydrogen group-containing compound to undergo elongating reaction and/or crosslinking reaction from the interfaces of the particles. Notably, in the case where the polyester resin reactive with the active hydrogen group and the active hydrogen group-containing compound are allowed to undergo elongating reaction and/or crosslinking reaction from the interfaces of the particles, a urea-modified polyester resin is formed preferentially in the surfaces of the formed toner and as a result, a concentration gradient of the urea-modified polyester resin can be provided in each toner particle.

The reaction conditions for forming the adhesive base (reaction time, reaction temperature) are not particularly limited and may be appropriately selected depending on the combination of the active hydrogen group-containing compound and the polyester resin having a functional group reactive with the active hydrogen group-containing compound.

The reaction time is not particularly limited and may be appropriately selected depending on the intended purpose. It is preferably 10 min to 40 hours, more preferably 2 hours to 24 hours.

The reaction temperature is not particularly limited and may be appropriately selected depending on the intended purpose. It is preferably 0° C. to 150° C., more preferably 40° C. to 98° C.

A method for stably dispersing, in the aqueous medium, the polyester resin having a functional group reactive with the active hydrogen group-containing compound such as the isocyanate group-containing polyester prepolymer is not particularly limited and may be appropriately selected depending on the intended purpose. Examples of the method include a method in which the oil phase containing the toner materials dissolved or dispersed in the solvent is added to the aqueous medium where they are dispersed through application of shearing force.

The dispersion apparatus used for the dispersing is not particularly limited and may be appropriately selected depending on the intended purpose. Examples thereof include low-speed shearing dispersion apparatus, high-speed shearing dispersion apparatus, friction dispersion apparatus, high-pressure jetting dispersion apparatus and ultrasonic wave dispersion apparatus.

In order for the dispersoids (oil droplets) to have a particle diameter of 2 μm to 20 μm, a high-speed shearing dispersing apparatus is preferably used.

In use of the high-speed shearing dispersing apparatus, the working conditions such as rotating speed, dispersion time and dispersion temperature may be appropriately selected depending on the intended purpose.

The rotating speed is not particularly limited and may be appropriately selected depending on the intended purpose. It is preferably 1,000 rpm to 30,000 rpm, more preferably 5,000 rpm to 20,000 rpm.

The dispersion time is not particularly limited and may be appropriately selected depending on the intended purpose. When a batch method is employed, it is preferably 0.1 min to 5 min.

The dispersion temperature is not particularly limited and may be appropriately selected depending on the intended purpose. Under a pressurized state, it is preferably 0° C. to 150° C., more preferably 40° C. to 98° C. In general, the dispersion is easily performed at higher dispersion temperature.

The amount of the aqueous medium used in the emulsifying or dispersing the toner materials is not particularly limited and may be appropriately selected depending on the intended purpose. It is preferably 50 parts by mass to 2,000 parts by mass, 100 parts by mass to 1,000 parts by mass, per 100 parts by mass of the toner materials.

When the amount of the aqueous medium is less than 50 parts by mass, the toner materials cannot be sufficiently dispersed, resulting in failure to form toner base particles having a predetermined particle diameter. Meanwhile, use of the aqueous medium more than 2,000 parts by mass may elevate production cost.

In emulsifying or dispersing the oil phase containing the toner materials, a dispersing agent is preferably used in order for dispersoids (e.g., oil droplets) to be stabilized, to have a desired shape and to have a sharp particle size distribution.

The dispersing agent is not particularly limited and may be appropriately selected depending on the intended purpose. Examples thereof include a surfactant, a poorly water-soluble inorganic compound dispersing agent and a polymeric protective colloid. These may be used alone or in combination.

Among them, a surfactant is preferred.

The surfactant is not particularly limited and may be appropriately selected depending on the intended purpose. Examples thereof include an anionic surfactant, a cationic surfactant, a nonionic surfactant and an amphoteric surfactant.

The anionic surfactant is not particularly limited and may be appropriately selected depending on the intended purpose. Examples thereof include alkylbenzenesulfonic acid salts, α-olefin sulfonic acid salts and phosphoric acid esters.

Among them, fluoroalkyl group-containing compounds are preferred.

A catalyst may be used in the elongating reaction and/or crosslinking reaction for forming the adhesive base.

The catalyst is not particularly limited and may be appropriately selected depending on the intended purpose. Examples thereof include dibutyltinlaurate and dioctyltinlaurate.

—Removal of Organic Solvent—

The method for removing the organic solvent from the dispersion liquid such as the emulsified slurry is not particularly limited and may be appropriately selected depending on the intended purpose. Examples thereof include a method in which the entire system is gradually increased in temperature to evaporate off the organic solvent and a method in which the dispersion liquid is sprayed into a dry atmosphere to evaporate off the organic solvent contained in the oil droplets.

After the organic solvent has been removed, toner base particles are obtained. The toner base particles may be subjected to, for example, washing and drying, and further may be subjected to, for example, classification. The classification may be performed by removing fine particles with a cyclone, a decanter or a centrifuge. The classification may be performed after drying.

The obtained toner base particles may be mixed with particles such as the external additive and charge controlling agent. Here, a mechanical impact may be applied to the mixture for preventing such particles from dropping off from the surfaces of the toner base particles.

The method for applying a mechanical impact is not particularly limited and may be appropriately selected depending on the intended purpose. Examples thereof include a method in which an impact is applied to the mixture using a high-speed rotating blade, and a method in which an impact is applied by putting mixed particles into a high-speed air flow and accelerating the air speed such that the particles collide against one another or that the particles are crashed into a proper collision plate.

The apparatuses used in these methods are not particularly limited and may be appropriately selected depending on the intended purpose. Examples thereof include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

(Developer)

The developer of the present invention contains at least a toner; and, if necessary, further contains a carrier and other ingredients.

The toner is the toner of the present invention.

The developer of the present invention may be a one-component developer or a two-component developer.

<Carrier>

The carrier is not particularly limited and may be appropriately selected depending on the intended purpose. The carrier preferably has a core material and a resin layer coating the core material.

—Core Material—

The material of the core material is not particularly limited and may be appropriately selected depending on the intended purpose. For example, it is preferable to employ manganese-strontium (Mn—Sr) materials (50 emu/g to 90 emu/g) or manganese-magnesium (Mn—Mg) materials (50 emu/g to 90 emu/g). Further, it is preferably to employ high magnetization materials such as iron powder (100 emu/g or more) or magnetite (75 emu/g to 120 emu/g) for the purpose of securing image density. Moreover, it is preferably to employ low magnetization materials such as copper-zinc (Cu—Zn) (30 emu/g to 80 emu/g) because the impact toward the photoconductor having a toner in the form of magnetic brush can be relieved and because it is advantageous for higher image quality. These materials may be used alone or in combination.

The particle diameter of the core materials is not particularly limited and may be appropriately selected depending on the intended purpose. The core materials have an average particle diameter (mass average particles diameter (D50)) of 10 μm to 200 μm, more preferably 40 μm to 100 μm.

When the average particle diameter (mass average particle diameter (D50)) is less than 10 μm, the amount of fine powder increases in the particle size distribution of the carrier, whereas magnetization per particle decreases and carrier scattering may occur. When it is greater than 200 μm, the specific surface area of the carrier decreases and thus toner scattering may occur. As a result, in the case of printing a full-color image having many solid portions, especially the reproduction of the solid portions may decrease.

—Resin Layer—

The material of the resin layer is not particularly limited and may be appropriately selected depending on the intended purpose. Examples thereof include amino-based resins, polyvinyl-based resins, polystyrene-based resins, halogenated olefin resins, polyester-based resins, polycarbonate-based resins, polyethylene resins, polyvinyl fluoride resins, polyvinylidene fluoride resins, polytrifluoroethylene resins, polyhexafluoropropylene resins, copolymers formed of vinylidene fluoride and an acrylic monomer, copolymers formed of vinylidene fluoride and vinyl fluoride, fluoroterpolmers such as terpolymers formed of tetrafluoroethylene, vinylidene fluoride and a non-fluorinated monomer, and silicone resins. These may be used alone or in combination.

Examples of the amino-based resins include urea-formaldehyde resins, melamine resins, benzoguanamine resins, urea resins, polyamide resins and epoxy resins. Examples of the polyvinyl-based resins include acrylic resins, polymethyl methacrylate resins, polyacrylonitrile resins, polyvinyl acetate resins, polyvinyl alcohol resins and polyvinyl butyral resins. Examples of the polystyrene-based resins include polystyrene resins and styrene-acrylic copolymer resins. Examples of the halogenated olefin resins include polyvinyl chloride. Examples of the polyester resins include polyethylene terephthalate resins and polybutylene terephthalate resins.

If necessary, the resin layer may further contain, for example, conductive powder. Examples of the material for the conductive powder include metals, carbon black, titanium oxide, tin oxide and zinc oxide. The average particle diameter of the conductive powder is preferably 1 μm or smaller. When the average particle diameter is in excess of 1 μm, electrical resistance may be difficult to control.

The resin layer may be formed, for example, as follows. Specifically, a silicone resin, etc. are dissolved in a solvent to prepare a coating liquid, and then the thus-prepared coating liquid is uniformly applied onto the core surface with a known coating method, followed by drying and then baking. Examples of the coating method include immersion methods, spray methods and brush coating methods.

The solvent is not particularly limited and may be appropriately selected depending on the intended purpose. Examples thereof include toluene, xylene, methyl ethyl ketone, methyl isobutyl ketone, cellosolve and butyl acetate.

The baking method is not particularly limited and may be appropriately selected depending on the intended purpose. It may be an external or internal heating method.

The apparatus for the baking is not particularly limited and may be appropriately selected depending on the intended purpose. Examples thereof include methods employing a fixed-type electric furnace, a fluid-type electric furnace, a rotary electric furnace or a burner furnace; and methods employing microwave radiation.

The amount of the resin layer contained in the carrier is preferably 0.01% by mass to 5.0% by mass on the basis of the total amount of the carrier. When the amount is less than 0.01% by mass, a uniform resin layer may not be formed on the surface of a carrier. Whereas when the amount is more than 5.0% by mass, the formed resin layer becomes too thick to cause adhesion between carrier particles, potentially resulting in failure to form uniform carrier particles.

The amount of the carrier contained in the developer is not particularly limited and may be appropriately selected depending on the intended purpose. It is preferably 90% by mass to 98% by mass, more preferably 93% by mass to 97% by mass.

Regarding the mixing ratio of the toner and the carrier in the developer, the amount of the toner is generally 1 part by mass to 10.0 parts by mass per 100 parts by mass of the carrier.

(Image Forming Apparatus and Image Forming Method)

An image forming apparatus of the present invention includes at least a latent electrostatic image bearing member, a latent electrostatic image forming unit, a developing unit, a transfer unit and a fixing unit; and, if necessary, further includes other units such as a charge-eliminating unit, a cleaning unit, a recycling unit and a controlling unit.

An image forming method of the present invention includes at least a latent electrostatic image forming step, a developing step, a transfer step and a fixing step; and, if necessary, further includes other steps such as a charge-eliminating step, a cleaning step, a recycling step and a controlling step.

The image forming method of the present invention can suitably be performed by the image forming apparatus of the present invention; the latent electrostatic image forming step can be performed by the latent electrostatic image forming unit; the developing step can be performed by the developing unit; the transfer step can be performed by the transfer unit; the fixing step can be performed by the fixing unit; and the other steps can be performed by the other units.

<Latent Electrostatic Image Forming Step and Latent Electrostatic Image Forming Unit>

The latent electrostatic image forming step is a step of forming a latent electrostatic image on a latent electrostatic image bearing member.

In the latent electrostatic image bearing member (hereinafter may be referred to as "photoconductor" or "image bearing member), its material, shape, structure, size, etc. are not particularly limited and may be appropriately selected from those known in the art. It preferably has a drum shape. Also, the latent electrostatic image bearing member is made, for example, of inorganic photoconductor materials (e.g., amorphous silicon and serene) and organic photoconductor materials (e.g., polysilane and phthalopolymethine). Among them, amorphous silicon is preferably used in terms of attaining a long service life.

The amorphous silicon photoconductor may be, for example, a photoconductor having a support and a photoconductive layer of a-Si, which is formed on the support heated to 50° C. to 400° C. with a film forming method such as vacuum vapor deposition, sputtering, ion plating, thermal CVD, photo-CVD or plasma CVD. Of these, plasma CVD is suitably employed, in which gaseous raw materials are decomposed through application of direct current or high-frequency or microwave glow discharge to form an a-Si deposition film on the support.

The latent electrostatic image can be formed by the latent electrostatic image forming unit, for example, as follows: a surface of the photoconductor is charged and then imagewise exposed.

The latent electrostatic image forming unit includes at least a charging unit configured to charge the surface of the photoconductor, and an exposing unit configured to imagewise expose the surface of the photoconductor.

—Charging Unit—

The above charging can be performed by, for example, applying voltage to the photoconductor surface using a charging unit.

The charging unit is not particularly limited and may be appropriately selected depending on the intended purpose. Examples thereof include contact-type chargers known per se having, for example, a conductive or semiconductive roller, brush, film and rubber blade; and non-contact-type chargers utilizing colona discharge such as corotron and scorotron.

The charging unit may have any shape like a charging roller as well as a magnetic brush, a fur brush, etc. The shape thereof may be suitably selected according to the specification or configuration of the electrophotographic apparatus.

When the magnetic brush is used as the charging unit, the magnetic brush is composed of a charging means of various ferrite particles such as Zn—Cu ferrite, a non-magnetic conductive sleeve to support the ferrite particles, and a magnetic roller included in the non-magnetic conductive sleeve.

Also, when the fur brush is used as the charging unit, the fur brush may be a fur which is treated to be conductive with, for example, carbon, copper sulfide, a metal or a metal oxide as well as which is coiled around or mounted to a metal or a metal core treated to be conductive.

The charging unit is not limited to the aforementioned contact-type charging units. However, the contact-type charging units are preferably used from the viewpoint of producing an image forming apparatus in which the amount of ozone generated from the charging unit is reduced.

—Exposing Unit—

The charged electrophotographic photoconductor surface can be imagewise exposed to light, for example, using the exposing device.

The exposing device is not particularly limited, so long as it attains desired imagewise exposure on the surface of the photoconductor charged with the charging unit, and may be appropriately selected depending on the purpose. Examples of the exposing unit include various exposing units such as a copy optical exposing device, a rod lens array exposing device, a laser optical exposing device and a liquid crystal shutter exposing device.

A light source used for the exposing unit is not particularly limited and may be appropriately selected depending on the intended purpose. Examples thereof include usual light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, a filter may be used for applying light having a desired wavelength. The filter may be various filters such as sharp-cut filter, a band-pass filter, an infrared cut filter, a dichroic filter, an interference filter and a color conversion filter.

In the present invention, light may be imagewise applied from the side facing the photoconductor support.

<Developing Step and Developing Unit>

The developing step is a step of developing the latent electrostatic image with a toner or a developer to form a visible image.

The toner is the toner of the present invention.

The developer is the developer of the present invention.

The visible image can be formed with the developing unit by, for example, developing the latent electrostatic image using the toner or developer.

The developing unit is not particularly limited, so long as it attains developing with the toner or developer, and may be appropriately selected from known developing units. Examples of preferred developing units include those having a developing device which has the toner or developer therein and which can apply the toner or developer to the latent electrostatic image in a contact or non-contact manner.

The above developing device may employ a dry or wet developing process, and may be a single-color or multi-color developing device. Examples of preferred developing devices include those having a rotatable magnetic roller and a stirrer for charging the toner or developer with friction caused during stirring.

In the developing device, toner particles and carrier particles are stirred and mixed so that the toner particles are charged by friction generated therebetween. The charged toner particles are retained in the chain-like form on the surface of the rotating magnetic roller to form a magnetic brush. The magnetic roller is disposed proximately to the photoconductor and thus, some of the toner particles forming the magnetic brush on the magnet roller are electrically transferred onto the photoconductor surface. As a result, the latent electrostatic image is developed with the toner particles to form a visual toner image on the photoconductor surface.

<Transfer Step and Transfer Unit>

The transfer step is a step of transferring the visible image onto the recording medium. In a preferred embodiment, visible images are primarily transferred onto an intermediate transfer medium, from which the visible image is secondarily transferred onto the recording medium.

The transfer can be performed by, for example, charging the photoconductor using a transfer charger, and can be performed by the transfer unit. The transfer unit preferably has a primary transfer unit configured to transfer visible images onto an intermediate transfer medium to form a composite transfer image, and a secondary transfer unit configured to transfer the composite transfer image onto a recording medium.

Here, when the image to be transferred onto the recording medium is a color image of several color toners, in one employable configuration, the transfer unit superposes the color toner images on top of another on the intermediate transfer medium to form an image on the intermediate transfer medium, and the image on the intermediate transfer medium is secondarily transferred at one time onto the recording medium by an intermediate transfer unit.

Notably, the intermediate transfer medium is not particularly limited and may be appropriately selected from known transfer media depending on the intended purpose. Preferred examples thereof include a transfer belt.

The transfer unit (the primary transfer unit and the secondary transfer unit) preferably has at least a transfer device which transfers the visible images formed on the photoconductor onto the recording medium through charging. The number of the transfer units may be one or more. Examples of the transfer device include a corona transfer device using corona discharge, a transfer belt, a transfer roller, a press transfer roller and an adhesion transfer device.

Notably, the recording medium is typically plane paper, but it is not particularly limited and may be appropriately selected depending on the intended purpose, so long as it can receive an unfixed image after developing. PET bases for OHP can also be used as the recording medium.

<Fixing Step and Fixing Unit>

The fixing step is a step of fixing the transferred visible image on the recording medium. In this step, fixing may be performed ever time when an image of each color toner is transferred onto the recording medium, or at one time (at the same time) on a laminated image of color toners.

The fixing step can be performed by the fixing unit.

The fixing unit is not particularly limited and may be appropriately selected depending on the intended purpose. It is preferably a known heat-pressing member. Examples of the heat-pressing member include a combination of a heating roller and a pressing roller; and a combination of a heating roller, a pressing roller and an endless belt.

In general, the heating temperature in the heating-pressing unit is preferably 80° C. to 200° C.

Notably, in the present invention, a known photo-fixing device, etc. is optionally used together with or instead of the fixing unit depending on the purpose.

The surface pressure at the fixing step is not particularly limited and may be appropriately selected depending on the intended purpose. It is preferably 10 $N/cm^2$ to 80 $N/cm^2$.

The fixing step is preferably performed with a fixing unit configured to heat and fix the toner image on the recording medium and containing a heat generator, one or more heat transfer media heated by the heat generator and a press member for pressing the recording medium against one of the heat transfer media.

Preferably, at least one of the heat transfer media is a belt-shaped heat transfer medium, and the belt-shaped heat transfer medium is used with a certain amount of oil applied on the surface thereof or with no oil applied on the surface thereof.

Here, the description "with a certain amount of oil applied on the surface thereof or with no oil applied on the surface thereof" means that 4 mg or less of oil is applied on the belt-shaped heat transfer medium in the area of A4 size, and more specifically, means that a trace amount of 0 mg to 4 mg of oil is applied on the belt-shaped heat transfer medium in the area of A4 size. Needless to say, this description encompasses the case where no oil is applied thereon.

Figure 3:
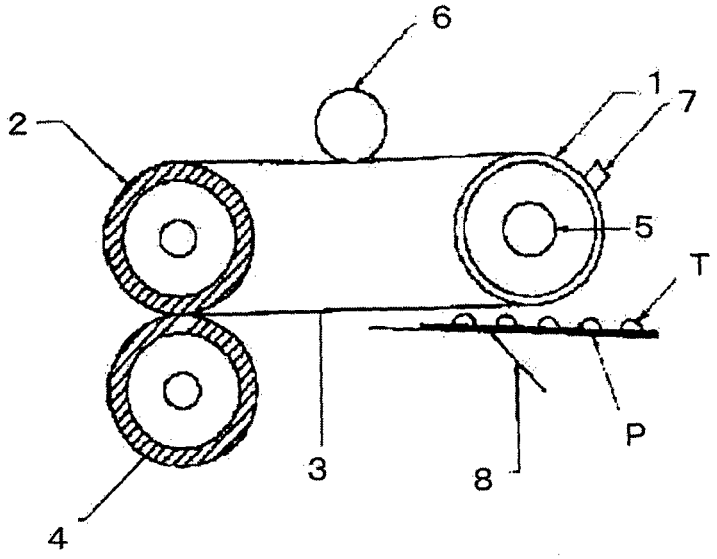
FIG. 3 is a schematic, structural view of one exemplary fixing unit.

Here, one example of the fixing unit is shown in FIG. 3. In this figure, reference numeral 2 denotes a fixing roller containing a metal core made of a metal (e.g., aluminum or iron) and an elastic material (e.g., silicone rubber) covering the metal core, and reference numeral 1 denotes a heating roller having a hollow cylindrical metal core (pipe made of, for example, aluminum, iron, copper or stainless steel) and a heat source 5 located in the hollow cylindrical metal core. Reference numeral 7 denotes a temperature sensor for measuring the temperature of a surface of a fixing belt 3 where the fixing belt is in contact with the heating roller 1. The fixing belt 3 is wound around the fixing roller 2 and the heating roller 1 in a stretched manner. The fixing belt 3 has a structure with a small heat capacity in which a base (e.g., a nickel base or a polyimide base) (thickness: about 30 μm to about 150 μm) is provided with a releasing layer (e.g., a layer of silicone rubber having a thickness of 50 μm to 300 μm or a layer of fluorine resin having a thickness of about 10 μm to about 50 μm). Also, reference numeral 4 denotes a pressing roller having a metal core and an elastic material covering the metal core. The pressing roller presses, from below, the fixing roller 2 via the fixing belt 3 to form a nip portion between the fixing belt 3 and the heating roller 4. The dimensions of each member are set depending on various conditions required. In this figure, reference numeral 6 denotes an oil applying roller, reference numeral 8 denotes a guide, reference character P denotes an image receiving paper, and reference character T denotes toner on the image receiving paper.

<Charge-Eliminating Step and Charge-Eliminating Unit>

The charge-eliminating step is a step of charge-eliminating the photoconductor by applying charge-eliminating bias thereto, and can be suitably performed by a charge-eliminating unit.

The charge-eliminating unit is not particularly limited, so long as it can apply charge-eliminating bias to the photoconductor, and may be appropriately selected from known charge-eliminating devices. Preferred examples thereof include a charge-eliminating lamp.

<Cleaning Step and Cleaning Unit>

The cleaning step is a step of removing the toner remaining on the photoconductor, and can be suitably performed by a cleaning unit. Notably, instead of the cleaning unit, a sliding member may be used to make the residual toner to have the same charge and the thus-treated toner may be recovered by a developing roller.

The cleaning unit is not particularly limited, so long as it can remove the toner remaining on the photoconductor, and may be appropriately selected from known cleaners. Preferred examples thereof include a magnetic brush cleaner, an electrostatic brush cleaner, a magnetic roller cleaner, a blade cleaner, a brush cleaner and a web cleaner.

<Recycling Step and Recycling Unit>

The recycling step is a step of recycling the toner removed at the cleaning step to developing unit, and can be suitably performed by a recycling unit. The recycling unit is not particularly limited and may be a known conveying unit, for example.

<Controlling Step and Controlling Unit>

The controlling step is a step of controlling each of the above steps, and can be suitably performed by a controlling unit.

The controlling unit is not particularly limited, so long as it can control the operation of each unit, and may be appropriately selected depending on the intended purpose. Examples thereof include devices such as a sequenser and a computer.

The image forming apparatus is preferably an image forming apparatus containing a process cartridge which integrally supports the latent electrostatic image bearing member and at least the developing unit and which is detachably mounted to the main body of the image forming apparatus.

Next, an image forming apparatus of the present invention will be described in detail with reference to the drawings. The image forming apparatus of the present invention should not be construed as being limited thereto.

Figure 4:
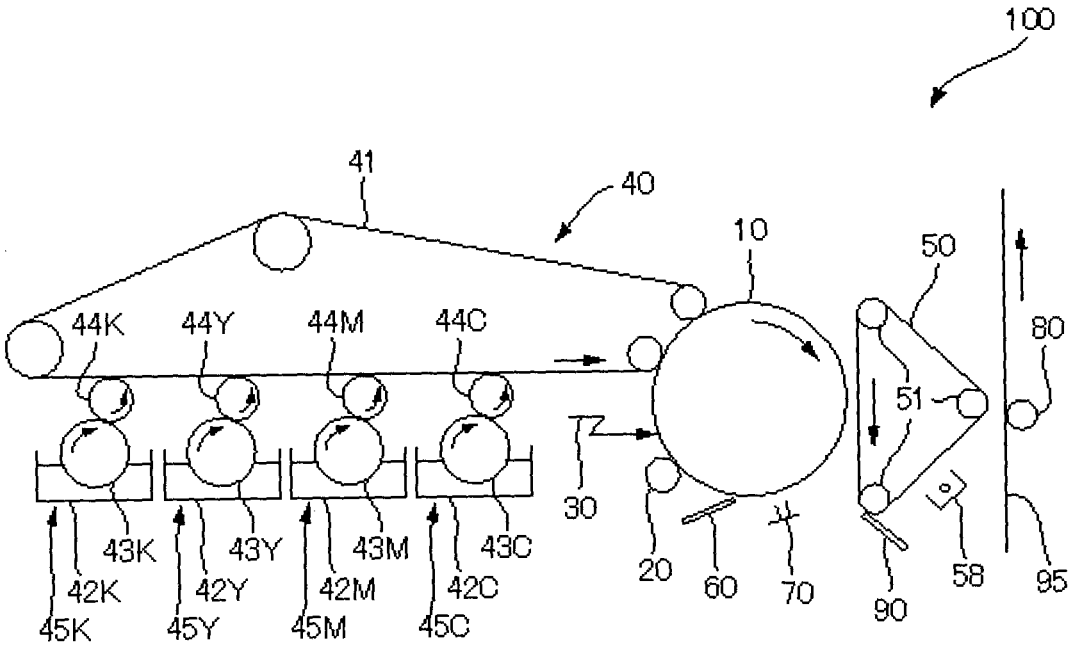
FIG. 4 is a schematic, structural view of one exemplary image forming apparatus of the present invention.

With reference to FIG. 4, next will be described an embodiment of the image forming method employing the image forming apparatus of the present invention. An image forming apparatus 100 shown in FIG. 4 includes a photoconductor drum 10 (hereinafter may be referred to as "photoconductor 10") serving as the latent electrostatic image bearing member, a charging roller 20 serving as the charging unit, an exposing device 30 serving as the exposing unit, a developing device 40 serving as the developing unit, an intermediate transfer member 50, a cleaning device 60 serving as the cleaning unit, and a charge-eliminating lamp 70 serving as the charge-eliminating unit.

The intermediate transfer member 50 is an endless belt and can be driven in a direction indicated by an arrow with three supporting rollers 51 which are provided in a loop of the belt. Some of three rollers 51 serve also as a transfer bias roller capable of applying a predetermined transfer bias (primary transfer bias) to the intermediate transfer member 50. A cleaning device 90 having a cleaning blade is disposed in the vicinity of the intermediate transfer member 50. Also, a transfer roller 80 is disposed so as to face the intermediate transfer member 50 and serves as a transfer unit capable of applying a transfer bias for transferring (secondarily transferring) a developed image (toner image) onto a recording paper sheet 95 (serving as a final recording medium). Around the intermediate transfer member 50, a corona charger 58 for applying charges to the toner image on the intermediate transfer member 50 is disposed a contact portion of the photoconductor 10 with the intermediate transfer member 50 or a contact portion of the intermediate transfer member 50 with the recording paper sheet 95.

The developing device 40 includes a developing belt 41 serving as the developer-carrier; and a black developing unit 45K, a yellow developing unit 45Y, a magenta developing unit 45M and a cyan developing unit 45C, these units being arranged in a row around the developing belt 41. The black developing unit 45K includes a developer accommodating section 42K, a developer supplying roller 43K, and a developing roller 44K. The yellow developing unit 45Y includes a developer accommodating section 42Y, a developer supplying roller 43Y, and a developing roller 44Y. The magenta developing unit 45M includes a developer accommodating section 42M, a developer supplying roller 43M, and a developing roller 44M. The cyan developing unit 45C includes a developer accommodating section 42C, a developer supplying roller 43C, and a developing roller 44C. The developing belt 41 is an endless belt and is rotatably supported by a plurality of belt rollers, some of which are in contact with the photoconductor 10.

In the color image forming apparatus 100 shown in FIG. 4, for example, the charging roller 20 uniformly charges the photoconductor drum 10. The photoconductor drum 10 is imagewise exposed by the exposing device 30 to form a latent electrostatic image. The latent electrostatic image formed on the photoconductor drum 10 is developed with a toner supplied from the developing device 40 to form a toner image. The toner image is transferred onto the intermediate transferring member 50 (primary transfer) with a voltage applied from the rollers 51. The thus-transferred image is transferred onto the recording paper 95 (secondary transfer). As a result, the transfer image is formed on the recording paper 95. Notably, toner particles remaining on the photoconductor 10 are removed by the cleaning device 60, and charges on the photoconductor 10 are removed by the charge-eliminating lamp 70.

Figure 5:
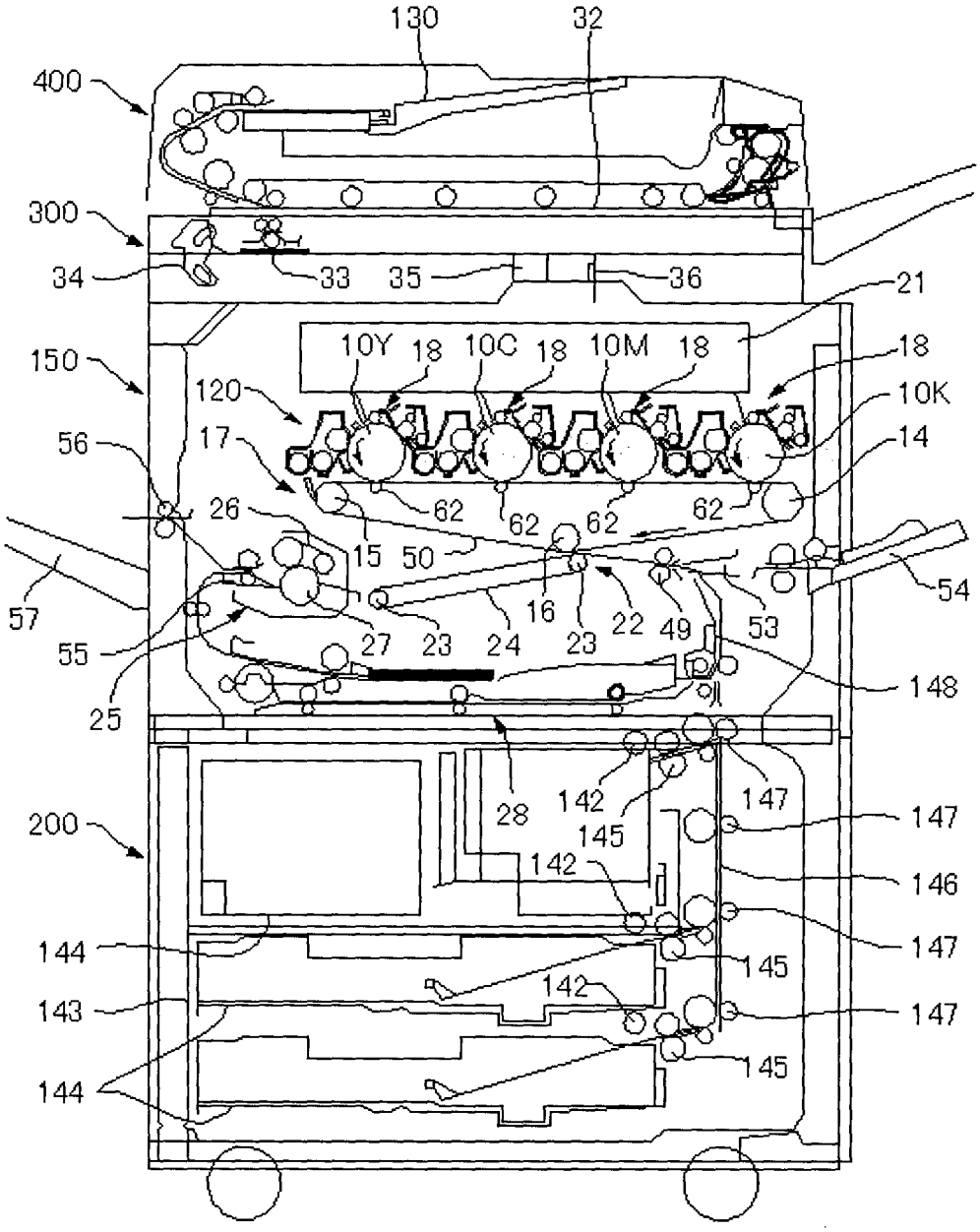
FIG. 5 is a schematic, structural view of another exemplary image forming apparatus of the present invention.

A color image forming apparatus shown in FIG. 5 includes a copying device main body 150, a paper feeding table 200, a scanner 300 and an automatic document feeder (ADF) 400.

The copying device main body 150 is provided at its center portion with an endless belt-shaped intermediate transferring member 50. In FIG. 5, the intermediate transfer member 50 can be clockwise rotated by supporting rollers 14, 15 and 16. A cleaning device 17 for removing toner particles remaining on the intermediate transfer member 50 is disposed in the vicinity of the supporting roller 15. Around the intermediate transfer member 50 tightly stretched by supporting rollers 14 and 15 is provided a tandem developing device 120 in which four image forming units 18 for yellow toner, cyan toner, magenta toner and black toner are arranged in a row along a moving direction of the intermediate transfer member. An exposing device 21 is provided in the vicinity of the tandem developing device 120. A secondary transfer device 22 is provided on the intermediate transfer member 50 on the side opposite to the side where the tandem developing device 120 is disposed. The secondary transfer device 22 includes an endless belt-shaped secondary transfer belt 24 and a pair of supporting rollers 23 tightly stretching the belt. A recording paper fed on the secondary transfer belt 24 can come into contact with the intermediate transfer member 50. A fixing device 25 is provided in the vicinity of the secondary transfer device 22. The fixing device 25 includes an endless fixing belt 26 and a press roller 27 provided so as to be pressed against the fixing belt.

Notably, in the tandem image forming apparatus, a sheet reversing device 28 for reversing the recording paper when image formation is performed on both sides of the recording paper is disposed in the vicinity of the secondary transfer device 22 and the fixing device 25.

Next will be described formation of a full color image (color copy) using the tandem developing device 120. Firstly, an original document is set on a document table 130 of the automatic document feeder (ADF) 400. Alternatively, the automatic document feeder 400 is opened and then an original document is set on a contact glass 32 of the scanner 300, followed by closing of the automatic document feeder 400.

In the former case, when a starting switch (not illustrated) is pressed, the scanner 300 is operated to run a first carriage 33 and a second carriage 34 after the original document has been transferred onto the contact glass 32. In the latter case, when a starting switch (not illustrated) is pressed, the scanner 300 is operated to run a first carriage 33 and a second carriage 34 immediately after the original document has been set on the contact glass 32. At that time, the first carriage 33 irradiates the original document with light from a light source, and then the second carriage 34 reflects, on its mirror, light reflected by the original document. The thus-reflected light is received by a reading sensor 36 through an imaging lens 35 for reading the original document (color image), to thereby form image information corresponding to black, yellow, magenta and cyan.

Figure 6:
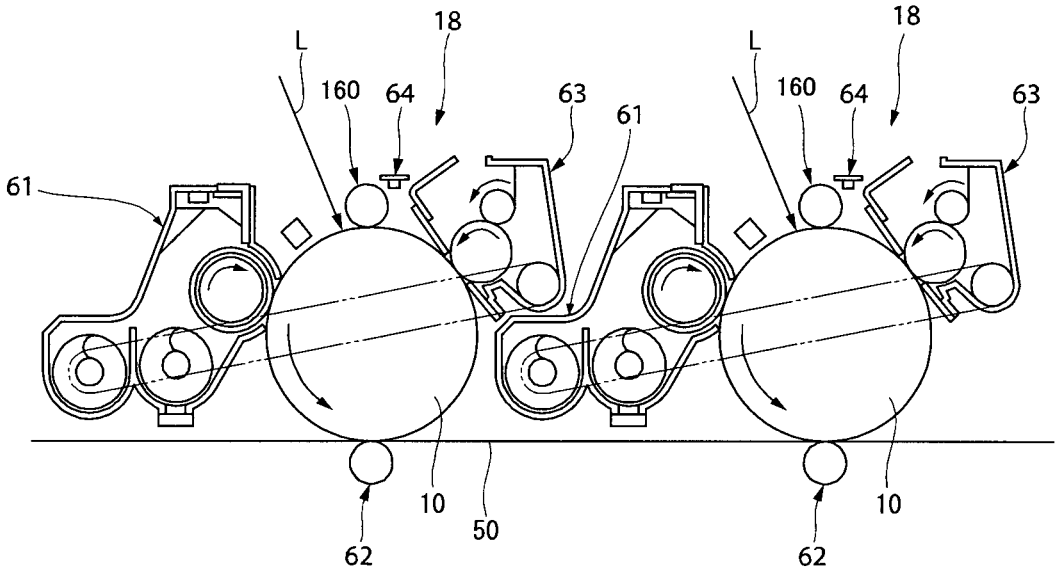
FIG. 6 is an enlarged view of a part of the image forming apparatus shown in FIG. 5.

The thus-formed image information corresponding to black, yellow, magenta and cyan is transferred to a corresponding image forming unit 18 (black-, yellow-, magenta- or cyan-image forming unit) in the tandem developing device 120, and then a toner image of each of black, yellow, magenta and cyan is formed with the image forming unit. Specifically, as shown in FIG. 6, each of the image forming units 18 (black-, yellow-, magenta- and cyan-image forming units) in the tandem developing device 120 includes a photoconductor 10 (black photoconductor 10K, yellow photoconductor 10Y, magenta photoconductor 10M or cyan photoconductor 10C); a charger 160 for uniformly charging the photoconductor 10; an exposing device for imagewise exposing the latent electrostatic image bearing member to light (indicated by a symbol L in FIG. 6) based on image information corresponding to black, yellow, magenta and cyan to form thereon a latent electrostatic image corresponding to each of black, yellow, magenta and cyan; a developing device 61 for developing the latent electrostatic image with each color toner (black toner, yellow toner, magenta toner and cyan toner) to form a color toner image; a transfer charger 62 for transferring the color toner image onto the intermediate transfer member 50; a cleaning device 63 for photoconductor; and a charge-eliminating device 64. With this configuration, each monochromatic image (black, yellow, magenta or cyan image) can be formed based on image information corresponding to each color. The thus-formed black, yellow, magenta and cyan images—a black image formed on the black photoconductor 10K, a yellow image formed on the yellow photoconductor 10Y, a magenta image formed on the magenta photoconductor 10M, and a cyan image formed on the cyan photoconductor 10C—are sequentially transferred (primarily transferred) onto the intermediate transfer member 50 driven by the supporting rollers 14, 15 and 16 so as to be rotated. Then, the black, yellow, magenta and cyan images are superposed on the intermediate transfer member 50 to form a composite color image (transferred color image).

In the paper feeding table 200, one of paper feeding rollers 142 is selectively rotated to feed sheets (recording paper) from one of vertically stacked paper feeding cassettes 144 housed in a paper bank 143. The thus-fed sheets are separated one another by a separating roller 145. The thus-separated sheet is fed through a paper feeding path 146, then fed through a paper feeding path 148 in a copying device main body 150 by a transfer roller 147, and stopped at a resist roller 49. Alternatively, paper feeding rollers 142 are rotated to feed sheets (recording paper) placed on a manual-feeding tray 54. The thus-fed sheets are separated one another by a separating roller 145. The thus-separated sheet is fed through a manual paper-feeding path 53 and then stopped at a resist roller 49 similar to the above. Notably, the resist roller 49 is generally connected to the ground in use. Alternatively, it may be used with being applied by a bias for removing paper dust from the sheet. The resist roller 49 is rotated to feed a sheet (recording paper) to between the intermediate transfer member 50 and the secondary transfer device 22, so that the composite color image (transferred color image) formed on the intermediate transfer member 50 is transferred (secondarily transferred) by the secondary transfer device 22 onto the sheet (recording paper), whereby a color image is formed on the sheet (recording paper). Notably, toner particles remaining on the intermediate transfer member 50 after image transfer is removed by a cleaning device 17 for cleaning the intermediate transfer member.

The sheet (recording paper) having a color image is fed by the secondary transfer device 22 to a fixing device 25. The fixing device 25 fixes the composite color image (transferred color image) on the sheet (recording paper) through application of heat and pressure. Subsequently, the sheet (recording paper) is discharged from a discharge roller 56 by a switching claw 55 and then stacked on a discharge tray 57. Alternatively, the sheet (recording paper) is switched by a switching claw 55 and reversed by a sheet reversing device 28. The reversed sheet is led again to the transfer position where an image is recorded on the back surface. The sheet is discharged from a discharge roller 56 and then stacked on a discharge tray 57.

EXAMPLES

The present invention will next be described by way of Examples, which should not be construed as limiting the present invention thereto. Notably, in Examples, the unit "part(s)" means "part(s) by mass."

Production Examples 1 to 3

Synthesis of Fine Particle Dispersion Liquids 1 to 3

A reaction container to which a stirring rod and a thermometer had been set was charged with the ion-exchange water, emulsifying agent and monomers described in Table 1, and the resultant mixture was stirred at 1,000 rpm for 30 min to thereby obtain a white emulsion. The reaction system was heated to a temperature of 75° C., followed by reaction for 5 hours. In addition, 30 parts of 1% by mass aqueous solution of ammonium persulfate was added to the reaction mixture, and the resultant mixture was aged at the temperature and for the time shown in Table 1, to thereby obtain [fine particle dispersion liquids 1 to 3].

Part of each of the [fine particle dispersion liquids 1 to 3] was dried to separate resin.

TABLE 1

| | | Production Ex. 1 Fine particle dispersion liquid 1 | Production Ex. 2 Fine particle dispersion liquid 2 | Production Ex. 3 Fine particle dispersion liquid 3 |
|---|---|---|---|---|
| Ion-exchange water | parts | 683 | 683 | 683 |
| Emulsifying agent | parts | 11 | 11 | 11 |
| Styrene | parts | 69 | 138 | 207 |
| Methacrylic acid | parts | 138 | 138 | 138 |
| Butyl acrylate | parts | 69 | — | — |
| Aging temperature | ° C. | 75 | 75 | 75 |
| Aging time | hours | 8 | 5 | 4 |

In Table 1, the emulsifying agent is ELEMINOL RS-30 (product of Sanyo Chemical Industries, Ltd.).

Production Example 4

Synthesis of Crystalline Polyester Resin 1 and Preparation of Crystalline Polyester Resin Dispersion Liquid 1

A 5 L four-neck flask equipped with a nitrogen-introducing pipe, a drainpipe, a stirrer and a thermocouple was charged with 1,10-decanedioic acid (2,300 parts), 1,4-butandiol (2,530 parts) and hydroquinone (4.9 parts), followed by reaction at 160° C. for 10 hours. Thereafter, the reaction mixture was allowed to react at 200° C. for 5 hours and further react at 8.3 kPa for 2 hours, to thereby produce [crystalline polyester resin 1].

The [crystalline polyester resin 1] (100 g) and ethyl acetate (400 g) were added to a 2 L metal container. The resultant mixture was dissolved or dispersed at 75° C. under heating and then quenched in an ice-water bath at a temperature decreasing rate of 27° C./min. Subsequently, glass beads (3 mm in diameter) (500 mL) were added to the mixture, followed by pulverizing for 10 hours with a batch-type sand mill (product of Kanpe Hapio Co., Ltd.), to thereby obtain [crystalline polyester resin dispersion liquid 1].

Production Example 5

Synthesis of Crystalline Polyester Resin 2 and Preparation of Crystalline Polyester Resin Dispersion Liquid 2

A 5 L four-neck flask equipped with a nitrogen-introducing pipe, a drainpipe, a stirrer and a thermocouple was charged with 1,10-decanedioic acid (2,300 parts), 1,4-butandiol (2,530 parts) and hydroquinone (4.9 parts), followed by reaction at 160° C. for 8 hours. Thereafter, the reaction mixture was allowed to react at 200° C. for 3 hours and further react at 8.3 kPa for 2 hours, to thereby produce [crystalline polyester resin 2].

The procedure for producing the crystalline polyester resin dispersion liquid 1 was repeated, except that the crystalline polyester resin 1 was changed to the crystalline polyester resin 2, to thereby obtain crystalline polyester resin dispersion liquid 2.

The below Table 2 shows the weight average molecular weight (Mw), number average molecular weight (Mn) and Mw/Mn of the crystalline polyester resins obtained in Production Examples 4 and 5. Notably, the Mw and Mn were measured by the method described herein.

TABLE 2

| | | Production Ex. 4 Crystalline PES1 | Production Ex. 5 Crystalline PES2 |
|---|---|---|---|
| Molecular weight of crystalline PES | Mw | 8,000 | 11,000 |
| | Mn | 2,300 | 2,300 |
| | Mw/Mn | 3.5 | 4.8 |

In Table 2, the crystalline PES means crystalline polyester resin.

Production Example 6

Synthesis of Unmodified Polyester Resin 1
(Non-Crystalline Polyester Resin)

A 5 L four-neck flask equipped with a nitrogen-introducing pipe, a drainpipe, a stirrer and a thermocouple was charged with bisphenol A ethylene oxide 2 mole adduct (229 parts), bisphenol A propylene oxide 3 mole adduct (350 parts), isophthalic acid (100 parts), terephthalic acid (108 parts), adipic acid (46 parts) and dibutyltin oxide (2 parts). The reaction mixture was allowed to react under normal pressure at 200° C. for 12 hours and further react under a reduced pressure of 10 mmHg to 15 mmHg for 4 hours. Then, trimellitic anhydride (45 parts) was added to the reaction container, followed by reaction at 170° C. under normal pressure for 3 hours, to thereby synthesize [unmodified polyester resin 1]. The [unmodified polyester resin 1] was found to have a Tg of 52° C.

Production Example 7

Synthesis of Unmodified Polyester Resin 2
(Non-Crystalline Polyester Resin)

A 5 L four-neck flask equipped with a nitrogen-introducing pipe, a drainpipe, a stirrer and a thermocouple was charged with bisphenol A ethylene oxide 2 mole adduct (290 parts), bisphenol A propylene oxide 3 mole adduct (405 parts), terephthalic acid (148 parts), dodecenylsuccinic anhydride (56 parts) and dibutyltin oxide (2 parts). The reaction mixture was allowed to react under normal pressure at 200° C. for 12 hours and further react under a reduced pressure of 10 mmHg to 15 mmHg for 4 hours. Then, trimellitic anhydride (50 parts) was added to the reaction container, followed by reaction at 170° C. under normal pressure for 3 hours, to thereby synthesize [unmodified polyester resin 2]. The [unmodified polyester resin 2] was found to have a Tg of 46° C.

Example 1

Production of Toner

—Synthesis of Polyester Prepolymer—

A reaction container equipped with a condenser, a stirrer and a nitrogen-introducing pipe was charged with bisphenol A ethylene oxide 2 mole adduct (510 parts), bisphenol A propylene oxide 2 mole adduct (124 parts), terephthalic acid (283 parts), trimellitic anhydride (22 parts) and dibutyltin oxide (2 parts). The resultant mixture was allowed to react under normal pressure at 200° C. for 10 hours and further react at a reduced pressure of 10 mmHg to 15 mmHg for 5 hours, to thereby produce [intermediate polyester].

Next, a reaction container equipped with a condenser, a stirrer and a nitrogen-introducing pipe was charged with 410 parts of [intermediate polyester], 89 parts of isophorone diisocyanate and 500 parts of ethyl acetate, followed by reaction at 100° C. for 5 hours, to thereby produce [prepolymer].

The amount of free isocyanate contained in [prepolymer] was found to be 1.5% by mass.

—Synthesis of Ketimine Compound—

A reaction container to which a stirring rod and a thermometer had been set was charged with isophorone diamine (170 parts) and methyl ethyl ketone (75 parts), followed by reaction at 50° C. for 5 hours, to thereby produce [ketimine compound].

The amine value of [ketimine compound] was found to be 418.

—Preparation of Masterbatch (MB)—

Water (1,200 parts), carbon black (Printex35, product of Degussa) [DBP oil absorption amount=42 mL/100 mg, pH=9.5] (540 parts) and the [unmodified polyester resin 1] (1,200 parts) were mixed together with HENSCHEL MIXER. The resultant mixture was kneaded at 130° C. for 1 hour with a two-roller mill, and then rolled, cooled and pulverized with a pulverizer, to thereby produce [masterbatch].

—Preparation of Oil Phase—

A container to which a stirring rod and a thermometer had been set was charged with the [unmodified polyester resin 1] (95 parts), paraffin wax (HNP-51; product of NIPPON SEIRO CO., LTD.) (110 parts), CCA (salycilic acid metal complex E-84: product of Orient Chemical Industries, Ltd.) (22 parts) and ethyl acetate (947 parts), and the mixture was heated to 80° C. under stirring. The resultant mixture was maintained at 80° C. for 5 hours and then cooled to 30° C. over 1 hour. Subsequently, [masterbatch] (500 parts) and ethyl acetate (500 parts) were charged into the container, followed by mixing for 1 hour, to thereby prepare [raw material solution].

The [raw material solution] (1,324 parts) was placed in a container, and the carbon black and WAX were dispersed with a beads mill (ULTRA VISCOMILL, product of AIMEX CO., Ltd.) under the following conditions: a liquid feed rate of 1 kg/hr, disc circumferential velocity of 6 m/s, 0.5 mm-zirconia beads packed in 80% by volume, and 3 passes.

Next, a 65% by mass ethyl acetate solution of the [unmodified polyester resin 1] (522 parts) was added thereto, and passed once with the beads mill under the above conditions, to thereby obtain [pigment/WAX dispersion liquid]. The solid content of [pigment/WAX dispersion liquid] was found to be 50% by mass (130° C., 30 min).

—Preparation of Aqueous Phase—

Water (990 parts), [fine particle dispersion liquid 1] (83 parts), a 48.5% by mass aqueous solution of sodium dodecyldiphenyl ether disulfonate (ELEMINOL MON-7, product of Sanyo Chemical Industries Ltd.) (37 parts) and ethyl acetate (90 parts) were mixed together and stirred to obtain an opaque white liquid, which was used as [aqueous phase].

—Emulsification/Deformation/Desolvation—

The [pigment/WAX dispersion liquid] (332 parts), [ketimine compound] (4.6 parts), [prepolymer] and [crystalline polyester resin dispersion liquid 1] were placed in a container so that the ratio of the crystalline polyester resin to non-crystalline polyester resin (crystalline polyester resin/non-crystalline polyester resin) was 75/25 (by mass), followed by mixing for 30 min at 5,000 rpm with a TK homomixer (product of Tokushu Kika Kogyo Co., Ltd.). Thereafter, the [aqueous phase] (1,200 parts) was added to the container, and the resultant mixture was mixed with the TK homomixer at 13,000 rpm for 20 min, to thereby obtain [emulsified slurry].

A container to which a stirrer and a thermometer had been set was charged with the [emulsified slurry], followed by desolvation at 30° C. for 8 hours and aging at 45° C. for 5 hours, to thereby produce [dispersion slurry].

Here, the [ketimine compound] was mixed in an amount of 0.5% by mass with the mixture of the [pigment/WAX dispersion liquid], [prepolymer] and [crystalline polyester resin dispersion liquid].

—Washing/Drying—

The [dispersion slurry] (100 parts) was filtrated under reduced pressure and then subjected to a series of treatments (1) to (4) described below, to thereby obtain [filtration cake]:

(1): ion-exchanged water (100 parts) was added to the filtration cake, followed by mixing with a TK homomixer (at 12,000 rpm for 10 min) and then filtration;

(2): 10% by mass aqueous sodium hydroxide solution (100 parts) was added to the filtration cake obtained in (1), followed by mixing with a TK homomixer (at 12,000 rpm for 30 min) and then filtration under reduced pressure;

(3): 10% by mass hydrochloric acid (100 parts) was added to the filtration cake obtained in (2), followed by mixing with a TK homomixer (at 12,000 rpm for 10 min) and then filtration; and (4): ion-exchanged water (300 parts) was added to the filtration cake obtained in (3), followed by mixing with a TK homomixer (at 12,000 rpm for 10 min) and then filtration (this treatment (4) was performed twice).

The [filtration cake] was dried with an air-circulating drier at 45° C. for 48 hours, and then was caused to pass through a sieve with a mesh size of 75 μm, to thereby prepare [toner base particles].

Using HENSCHEL MIXER, the obtained toner base particles (100 parts) were mixed with 1.0 part of hydrophobic silica and 0.3 parts of hydrophobic titanium oxide, to thereby obtain a toner.

Per 100 parts of the obtained toner, the amount of the crystalline polyester resin was found to be 61.5 parts, the amount of the unmodified polyester resin was found to be 14.4 parts, and the amount of the modified polyester resin was found to be 6.2 parts.

<Production of Two-Component Developer>

Using a turblar mixer whose container rotates for stirring, 7 parts of each toner was uniformly mixed and charged with 100 parts of ferrite carrier coated with a silicone resin so as to have an average thickness of 0.5 μm (average particle diameter: 35 μm), whereby a two-component developer was produced.

—Production of Carrier—

Core Material

Mn ferrite particles (mass average particle diameter: 35 μm): 5,000 parts

Coating Materials

Toluene: 450 parts

Silicone resin: 450 parts (SR2400, product of Toray Dow Corning Silicone Co., non-volatile content: 50% by mass)

Aminosilane SH6020 (product of Toray Dow Corning Silicone Co.): 10 parts

Carbon black: 10 parts

The above coating materials were dispersed for 10 min with a stirrer to prepare a coat liquid. The thus-prepared coat liquid and the core material were charged to a coating apparatus having a rotary bottom disc and a stirring blade in a fluidized bed and performing coating while forming swirl flow, to thereby coat the core material with the coat liquid. The thus-coated products were baked in an electric furnace at 250° C. for 2 hours, to thereby produce the above carrier.

<Measurement>

—Measurement of Hardness (Dc) of Core and Hardness (Ds) of Shell—

SPM (Scanning Probe Microscope) was used to measure the hardness (Dc) of the core and the hardness (Ds) of the shell in the following manner.

First, the toner was embedded in an epoxy resin, followed by hardening. The hardened product was cut with an ultramicrotome (product of Leica Co., ULTRACUT UCT, using a diamond knife) to form a cross-section of the toner. Thereafter, the core and the shell of the toner were measured for force curve with SPM. To obtain an accurate force curve in the measurement, the gradient of the baseline wais corrected and the spring constant was calibrated. In the force curve, the horizontal axis indicates the movement of the piezo along the Z axis and the vertical axis indicates force. In the force curve obtained when the cantilever approaches the sample, "b" denotes a point where the cantilever comes into contact with the surface of the sample as a result of elongation of the Z piezo, and "a" denotes a point immediately before the cantilever starts to return at the trigger point after pressing down the sample. Here, the gradient of the line connecting the two points (i.e., line segment a-b) was used as the index of the hardness. In the measurement of the force curve, 20 points or greater were measured so as to secure a sufficient number of "n." The average of the measured gradients was used to calculate the hardness (Dc) of the core, the hardness (Ds) of the shell, and Ds/Dc. The results are shown in Table 4.

The measurement conditions are as follows.

SPM apparatus: model MFP-3D molecular force probe microscope system (product of Asylum Co.)

Measurement mode: force curve measurement (contact mode, closed loop)

Trigger point: Deflection voltage: 0.30 V to 0.35 V

Cantilever: AC240TS-C2 (spring constant: about 2 N/m)

—Average Thickness of Shell—

The average thickness of the shell of the toner was measured in the following manner.

The toner was embedded in an epoxy resin, followed by hardening. The hardened product was cut with an ultramicrotome (product of Leica Co., ULTRACUT UCT, using a diamond knife) to prepare an ultra-thin section of the toner (thickness: 70 nm). The thus-prepared sample (ultra-thin section) was exposed to gas of ruthenium tetroxide for 2 min for staining. Subsequently, the sample was observed under TEM (transmission electron microscope; product of JEOL Co., JEM-2100) at an acceleration voltage of 100 kV.

The average thickness of the shell was measured by measuring the thicknesses of the shells of randomly selected 10 particles and averaging the measured thicknesses. The results are shown in Table 4.

<Evaluation>

—Durability—

The obtained two-component developer (toner concentration: 7% by mass) was placed in a cylindrical stirring container, followed by stirring for 24 hours. Thereafter, the toner particles were recovered from the developer and then observed for their shape under FE-SEM (scanning electron microscope; ULTRA55; product of Zeiss Co.).

According to the following criteria, each toner (toner particles) was evaluated for durability based on the state where the toner was beaten and the state where the additives (external additives) were embedded in the toner. The evaluation results are shown in Table 4.

A: The toner was not beaten and the additives were not embedded in the toner.

B: The toner was not beaten but part of the additives was embedded in the toner.

C: Almost half the additives were embedded in the toner.
D: The toner was beaten and most of the additives were embedded in the toner.

—Low-Temperature Fixability—

A fixing portion of the copier MF-2200 (product of Ricoh Company, Ltd.) employing a TEFLON (registered trade mark) roller as a fixing roller was modified to produce a modified apparatus. This modified apparatus was used to fix each toner on Type 6000 paper sheets (product of Ricoh Company, Ltd.) as a solid image at a toner adhesion amount of 0.85 mg/cm$^2$±0.1 mg/cm$^2$.

Specifically, this fixing test was performed with changing the fixing temperature. The obtained fixed image was scratched with a needle-like tool and then rubbed with cloth. The state of the image was ranked according to the following 5 criteria: rank 5: no image was peeled off (0%); rank 4: 1% to 10% of the image was peeled off; rank 3: 11% to 30% of the image was peeled off, rank 2: 31% to 80% of the image was peeled off; and rank 1: 81% to 100% of the image was peeled off. The minimum fixing temperature measured when giving the state of the image ranked as rank 4 or the higher was defined as the minimum fixing temperature.

The conditions of the fixing test were as follows: paper feeding linear velocity: 282 mm/sec, surface pressure: 37 N/cm$^2$ and nip width: 3 nm.

The minimum fixing temperature was evaluated according to the following evaluation criteria. The results are shown in Table 4.

A: Minimum fixing temperature≤110° C.
B: 110° C.<Minimum fixing temperature≤120° C.
C: 120° C.<Minimum fixing temperature≤130° C.
D: 130° C.<Minimum fixing temperature —Heat Resistant Storage Stability—

Ten grams of each toner was weighed and placed in a 20 mL glass container. The glass container was tapped 100 times with a tapping device, and then left to stand for 24 hours in a thermostat bath set to 55° C. in temperature and 80% in humidity. The thus-treated toner was measured for penetration degree using a penetration tester (product of NIKKA ENGINEERING CO., LTD., under the conditions described in the manual). The measured penetration degree was evaluated according to the following evaluation criteria. The results are shown in Table 4.

A: 20 mm<Penetration degree
B: 15 mm<Penetration degree≤20 mm
C: 10 mm≤Penetration degree≤15 mm
D: Penetration degree<10 mm

Example 2

The procedure of Example 1 was repeated, except that in the emulsification, the amounts of the [prepolymer] and the [crystalline polyester resin dispersion liquid 1] were changed so that the ratio of the crystalline polyester resin/non-crystalline polyester resin in the obtained toner was 50/50 (by mass), to thereby obtain a toner and a developer.

Per 100 parts of the obtained toner, the amount of the crystalline polyester resin was found to be 41.0 parts, the amount of the unmodified polyester resin was found to be 28.7 parts, and the amount of the modified polyester resin was found to be 12.3 parts.

The obtained toner and developer were evaluated in the same manner as in Example 1. The evaluation results are shown in Table 4.

Example 3

The procedure of Example 1 was repeated, except that the fine particle dispersion liquid 1 was changed to the fine particle dispersion liquid 2 and that, in the emulsification, the amounts of the [prepolymer] and the [crystalline polyester resin dispersion liquid 1] were changed so that the ratio of the crystalline polyester resin/non-crystalline polyester resin in the obtained toner was 50/50 (by mass), to thereby obtain a toner and a developer.

Per 100 parts of the obtained toner, the amount of the crystalline polyester resin was found to be 41.0 parts, the amount of the unmodified polyester resin was found to be 28.7 parts, and the amount of the modified polyester resin was found to be 12.3 parts.

The obtained toner and developer were evaluated in the same manner as in Example 1. The evaluation results are shown in Table 4.

Example 4

The procedure of Example 1 was repeated, except that the fine particle dispersion liquid 1 was changed to the fine particle dispersion liquid 2 and that, in the emulsification, the amounts of the [prepolymer] and the [crystalline polyester resin dispersion liquid 1] were changed so that the ratio of the crystalline polyester resin/non-crystalline polyester resin in the obtained toner was 20/80 (by mass), to thereby obtain a toner and a developer.

Per 100 parts of the obtained toner, the amount of the crystalline polyester resin was found to be 16.4 parts, the amount of the unmodified polyester resin was found to be 45.9 parts, and the amount of the modified polyester resin was found to be 19.7 parts.

The obtained toner and developer were evaluated in the same manner as in Example 1. The evaluation results are shown in Table 4.

Example 5

The procedure of Example 1 was repeated, except that the fine particle dispersion liquid 1 was changed to the fine particle dispersion liquid 3 and that, in the emulsification, the amounts of the [prepolymer] and the [crystalline polyester resin dispersion liquid 1] were changed so that the ratio of the crystalline polyester resin/non-crystalline polyester resin in the obtained toner was 5/95 (by mass), to thereby obtain a toner and a developer.

Per 100 parts of the obtained toner, the amount of the crystalline polyester resin was found to be 4.1 parts, the amount of the unmodified polyester resin was found to be 54.5 parts, and the amount of the modified polyester resin was found to be 23.4 parts.

The obtained toner and developer were evaluated in the same manner as in Example 1. The evaluation results are shown in Table 4.

Example 6

The procedure of Example 2 was repeated, except that in the preparation of masterbatch (MB) and the preparation of oil phase, the [unmodified polyester resin 1] was changed to the [unmodified polyester resin 2], that in the emulsification, the [prepolymer] was changed to the [unmodified polyester resin 2] and that the [ketimine compound] was not used, to thereby obtain a toner and a developer.

Per 100 parts of the obtained toner, the amount of the crystalline polyester resin was found to be 41.0 parts and the amount of the unmodified polyester resin was found to be 41.0 parts.

The obtained toner and developer were evaluated in the same manner as in Example 1. The evaluation results are shown in Table 4.

Example 7

The procedure of Example 3 was repeated, except that in the preparation of masterbatch (MB) and the preparation of oil phase, the [unmodified polyester resin 1] was changed to the [unmodified polyester resin 2], that in the emulsification, the [prepolymer] was changed to the [unmodified polyester resin 2] and that the [ketimine compound] was not used, to thereby obtain a toner and a developer.

Per 100 parts of the obtained toner, the amount of the crystalline polyester resin was found to be 41.0 parts and the amount of the unmodified polyester resin was found to be 41.0 parts.

The obtained toner and developer were evaluated in the same manner as in Example 1. The evaluation results are shown in Table 4.

Example 8

The procedure of Example 4 was repeated, except that in the preparation of masterbatch (MB) and the preparation of oil phase, the [unmodified polyester resin 1] was changed to the [unmodified polyester resin 2], that in the emulsification, the [prepolymer] was changed to the [unmodified polyester resin 2] and that the [ketimine compound] was not used, to thereby obtain a toner and a developer.

Per 100 parts of the obtained toner, the amount of the crystalline polyester resin was found to be 16.4 parts and the amount of the unmodified polyester resin was found to be 65.6 parts.

The obtained toner and developer were evaluated in the same manner as in Example 1. The evaluation results are shown in Table 4.

Example 9

The procedure of Example 2 was repeated, except that the [crystalline polyester resin dispersion liquid 1] was changed to the [crystalline polyester resin dispersion liquid 2], to thereby obtain a toner and a developer.

Per 100 parts of the obtained toner, the amount of the crystalline polyester resin was found to be 41.0 parts, the amount of the unmodified polyester resin was found to be 28.7 parts, and the amount of the modified polyester resin was found to be 12.3 parts.

The obtained toner and developer were evaluated in the same manner as in Example 1. The evaluation results are shown in Table 4.

Example 10

The procedure of Example 3 was repeated, except that the [crystalline polyester resin dispersion liquid 1] was changed to the [crystalline polyester resin dispersion liquid 2], to thereby obtain a toner and a developer.

Per 100 parts of the obtained toner, the amount of the crystalline polyester resin was found to be 41.0 parts, the amount of the unmodified polyester resin was found to be 28.7 parts, and the amount of the modified polyester resin was found to be 12.3 parts.

The obtained toner and developer were evaluated in the same manner as in Example 1. The evaluation results are shown in Table 4.

Example 11

The procedure of Example 4 was repeated, except that the [crystalline polyester resin dispersion liquid 1] was changed to the [crystalline polyester resin dispersion liquid 2], to thereby obtain a toner and a developer.

Per 100 parts of the obtained toner, the amount of the crystalline polyester resin was found to be 16.4 parts, the amount of the unmodified polyester resin was found to be 45.9 parts, and the amount of the modified polyester resin was found to be 19.7 parts.

The obtained toner and developer were evaluated in the same manner as in Example 1. The evaluation results are shown in Table 4.

Example 12

The procedure of Example 2 was repeated, except that in the preparation of masterbatch (MB) and the preparation of oil phase, the [unmodified polyester resin 1] was changed to the [unmodified polyester resin 2], that in the emulsification, the [prepolymer] was changed to the [unmodified polyester resin 2], that the [ketimine compound] was not used and that the [crystalline polyester resin dispersion liquid 1] was changed to the [crystalline polyester resin dispersion liquid 2], to thereby obtain a toner and a developer.

Per 100 parts of the obtained toner, the amount of the crystalline polyester resin was found to be 41.0 parts and the amount of the unmodified polyester resin was found to be 41.0 parts.

The obtained toner and developer were evaluated in the same manner as in Example 1. The evaluation results are shown in Table 4.

Example 13

The procedure of Example 3 was repeated, except that in the preparation of masterbatch (MB) and the preparation of oil phase, the [unmodified polyester resin 1] was changed to the [unmodified polyester resin 2], that in the emulsification, the [prepolymer] was changed to the [unmodified polyester resin 2], that the [ketimine compound] was not used and that the [crystalline polyester resin dispersion liquid 1] was changed to the [crystalline polyester resin dispersion liquid 2], to thereby obtain a toner and a developer.

Per 100 parts of the obtained toner, the amount of the crystalline polyester resin was found to be 41.0 parts and the amount of the unmodified polyester resin was found to be 41.0 parts.

The obtained toner and developer were evaluated in the same manner as in Example 1. The evaluation results are shown in Table 4.

Example 14

The procedure of Example 4 was repeated, except that in the preparation of masterbatch (MB) and the preparation of oil phase, the [unmodified polyester resin 1] was changed to the [unmodified polyester resin 2], that in the emulsification, the [prepolymer] was changed to the [unmodified polyester resin 2], that the [ketimine compound] was not used and that the [crystalline polyester resin dispersion liquid 1] was changed to the [crystalline polyester resin dispersion liquid 2], to thereby obtain a toner and a developer.

Per 100 parts of the obtained toner, the amount of the crystalline polyester resin was found to be 16.4 parts and the amount of the unmodified polyester resin was found to be 65.6 parts.

The obtained toner and developer were evaluated in the same manner as in Example 1. The evaluation results are shown in Table 4.

Comparative Example 1

The procedure of Example 1 was repeated, except that the fine particle dispersion liquid 1 was changed to the fine particle dispersion liquid 2, to thereby obtain a toner and a developer.

Per 100 parts of the obtained toner, the amount of the crystalline polyester resin was found to be 61.5 parts, the amount of the unmodified polyester resin was found to be 14.4 parts, and the amount of the modified polyester resin was found to be 6.2 parts.

The obtained toner and developer were evaluated in the same manner as in Example 1. The evaluation results are shown in Table 4.

Comparative Example 2

The procedure of Example 1 was repeated, except that in the emulsification, the amounts of the [prepolymer] and the [crystalline polyester resin dispersion liquid 1] were changed so that the ratio of the crystalline polyester resin/non-crystalline polyester resin in the obtained toner was 20/80 (by mass), to thereby obtain a toner and a developer.

Per 100 parts of the obtained toner, the amount of the crystalline polyester resin was found to be 16.4 parts, the amount of the unmodified polyester resin was found to be 45.9 parts, and the amount of the modified polyester resin was found to be 19.7 parts.

The obtained toner and developer were evaluated in the same manner as in Example 1. The evaluation results are shown in Table 4.

Comparative Example 3

The procedure of Example 1 was repeated, except that in the emulsification, the amounts of the [prepolymer] and the [crystalline polyester resin dispersion liquid 1] were changed so that the ratio of the crystalline polyester resin/non-crystalline polyester resin in the obtained toner was 80/20 (by mass), to thereby obtain a toner and a developer.

Per 100 parts of the obtained toner, the amount of the crystalline polyester resin was found to be 65.6 parts, the amount of the unmodified polyester resin was found to be 11.5 parts, and the amount of the modified polyester resin was found to be 4.9 parts.

The obtained toner and developer were evaluated in the same manner as in Example 1. The evaluation results are shown in Table 4.

Comparative Example 4

The procedure of Example 1 was repeated, except that the fine particle dispersion liquid 1 was changed to the fine particle dispersion liquid 3 and that, in the emulsification, the amounts of the [prepolymer] and the [crystalline polyester resin dispersion liquid 1] were changed so that the ratio of the crystalline polyester resin/non-crystalline polyester resin in the obtained toner was 3/97 (by mass), to thereby obtain a toner and a developer.

Per 100 parts of the obtained toner, the amount of the crystalline polyester resin was found to be 2.5 parts, the amount of the unmodified polyester resin was found to be 55.7 parts, and the amount of the modified polyester resin was found to be 23.9 parts.

The obtained toner and developer were evaluated in the same manner as in Example 1. The evaluation results are shown in Table 4.

TABLE 3

| | FPDL | CPES resin | CPES resin/ non-CPES resin | Remarks |
|---|---|---|---|---|
| Ex. 1 | FPDL 1 | CPES resin 1 | 75/25 | Polyester prepolymer was used |
| Ex. 2 | FPDL 1 | CPES resin 1 | 50/50 | Polyester prepolymer was used |
| Ex. 3 | FPDL 2 | CPES resin 1 | 50/50 | Polyester prepolymer was used |
| Ex. 4 | FPDL 2 | CPES resin 1 | 20/80 | Polyester prepolymer was used |
| Ex. 5 | FPDL 3 | CPES resin 1 | 5/95 | Polyester prepolymer was used |
| Ex. 6 | FPDL 1 | CPES resin 1 | 50/50 | Unmodified polyester resin 2 was used |
| Ex. 7 | FPDL 2 | CPES resin 1 | 50/50 | Unmodified polyester resin 2 was used |
| Ex. 8 | FPDL 2 | CPES resin 1 | 20/80 | Unmodified polyester resin 2 was used |
| Ex. 9 | FPDL 1 | CPES resin 2 | 50/50 | Polyester prepolymer was used |
| Ex. 10 | FPDL 2 | CPES resin 2 | 50/50 | Polyester prepolymer was used |
| Ex. 11 | FPDL 2 | CPES resin 2 | 20/80 | Polyester prepolymer was used |
| Ex. 12 | FPDL 1 | CPES resin 2 | 50/50 | Unmodified polyester resin 2 was used |
| Ex. 13 | FPDL 2 | CPES resin 2 | 50/50 | Unmodified polyester resin 2 was used |
| Ex. 14 | FPDL 2 | CPES resin 2 | 20/80 | Unmodified polyester resin 2 was used |
| Comp. Ex. 1 | FPDL 2 | CPES resin 1 | 75/25 | Polyester prepolymer was used |
| Comp. Ex. 2 | FPDL 1 | CPES resin 1 | 20/80 | Polyester prepolymer was used |
| Comp. Ex. 3 | FPDL 1 | CPES resin 1 | 80/20 | Polyester prepolymer was used |
| Comp. Ex. 4 | FPDL 3 | CPES resin 1 | 3/97 | Polyester prepolymer was used |

In Table 3, "FPDL" denotes "fine partile dispersion liquid," "CPES resin" denotes "crystalline polyester resin," and "non-CPES resin" denotes "non-crystalline polyester resin." Also, "CPES resin/non-CPES resin" is a ratio (A/B) of a mass of the crystalline polyester resin (A) to a mass of the non-crystalline polyester resin (B).

TABLE 4

| | Ds | Dc | Ds/Dc | CPES resin/non-CPES resin | Ave. thickness of shell (μm) | Durability | Low-temp. fixability | Heat resistant storage stability |
|---|---|---|---|---|---|---|---|---|
| Ex. 1 | 1.50 | 1.31 | 1.15 | 75/25 | 0.5 | A | A | B |
| Ex. 2 | 1.58 | 1.31 | 1.21 | 50/50 | 0.4 | B | A | B |
| Ex. 3 | 1.45 | 1.38 | 1.05 | 50/50 | 0.3 | A | A | B |
| Ex. 4 | 1.49 | 1.00 | 1.49 | 20/80 | 0.2 | B | A | A |
| Ex. 5 | 1.31 | 1.15 | 1.14 | 5/95 | 0.4 | A | B | A |
| Ex. 6 | 1.56 | 1.23 | 1.27 | 50/50 | 0.3 | B | A | B |
| Ex. 7 | 1.46 | 1.22 | 1.20 | 50/50 | 0.2 | A | A | B |
| Ex. 8 | 1.47 | 1.28 | 1.15 | 20/80 | 0.1 | B | A | B |
| Ex. 9 | 1.55 | 1.18 | 1.31 | 50/50 | 0.3 | B | A | B |
| Ex. 10 | 1.45 | 1.16 | 1.25 | 50/50 | 0.2 | B | A | B |
| Ex. 11 | 1.47 | 1.22 | 1.20 | 20/80 | 0.4 | B | A | B |
| Ex. 12 | 1.58 | 1.09 | 1.45 | 50/50 | 0.3 | B | A | B |
| Ex. 13 | 1.44 | 1.02 | 1.41 | 50/50 | 0.3 | B | A | B |
| Ex. 14 | 1.47 | 1.16 | 1.27 | 20/80 | 0.2 | B | A | B |
| Comp. Ex. 1 | 1.41 | 1.37 | 1.03 | 75/25 | 0.3 | C | A | C |
| Comp. Ex. 2 | 1.52 | 0.99 | 1.54 | 20/80 | 0.4 | A | C | B |
| Comp. Ex. 3 | 1.59 | 1.23 | 1.29 | 80/20 | 0.3 | B | A | D |
| Comp. Ex. 4 | 1.39 | 1.19 | 1.17 | 3/97 | 0.6 | B | C | B |

In Table 4, "CPES resin" denotes "crystalline polyester resin," and "non-CPES resin" denotes "non-crystalline polyester resin." Also, "CPES resin/non-CPES resin" is a ratio (A/B) of a mass of the crystalline polyester resin (A) to a mass of the non-crystalline polyester resin (B).

From the evaluation results obtained in Examples 1 to 14 and Comparative Examples 1 to 4, the toner of the present invention was found to be excellent in low-temperature fixability and heat resistant storage stability as well as have sufficient durability to stress in the developing device.

INDUSTRIAL APPLICABILITY

The toner of the present invention is excellent in low-temperature fixability and heat resistant storage stability as well as has sufficient durability to stress in the developing device such as stirring and thus, is suitably used for image formation with reduced energy and high quality. The developer, image forming apparatus, and image forming method of the present invention each using the toner of the present invention is suitably used for image formation with reduced energy and high quality.

REFERENCE SIGNS LIST

1 Heating roller
2 Fixing roller
3 Fixing belt
4 Pressing roller
5 Heat source
6 Oil applying roller
7 Temperature sensor
8 Guide
10 Photoconductor (photoconductor drum)
10K Black photoconductor
10Y Yellow photoconductor
10M Magenta photoconductor
10C Cyan photoconductor
14 Supporting roller
15 Supporting roller
16 Supporting roller
17 Intermediate transfer member cleaning device
18 Image forming unit
20 Charging roller
21 Exposing device
22 Secondary transfer device
23 Roller
24 Secondary transfer belt
25 Fixing device
26 Fixing belt
27 Pressing roller
28 Sheet reversing device
30 Exposing device
32 Contact glass
33 First carriage
34 Second carriage
35 Imaging lens
36 Reading sensor
40 Developing device
41 Developing belt
42K Developer accommodating section
42Y Developer accommodating section
42M Developer accommodating section
42C Developer accommodating section
43K Developer supplying roller
43Y Developer supplying roller
43M Developer supplying roller
43C Developer supplying roller
44K Developing roller
44Y Developing roller
44M Developing roller
44C Developing roller
45K Black developing unit
45Y Yellow developing unit
45M Magenta developing unit
45C Cyan developing unit
49 Registration roller
50 Intermediate transfer member
51 Roller
53 Paper-feeding path
54 Manual-feeding tray
55 Switching claw
56 Discharge roller
57 Discharge tray
58 Corona charger
60 Cleaning device
61 Developing device
62 Transfer charger
63 Photoconductor cleaning device

64 Charge-eliminating device
70 Charge-eliminating lamp
80 Transfer roller
90 Cleaning device
95 Recording paper sheet
100 Color image forming apparatus
120 Tandem developing device
130 Document table
142 Paper feeding roller
143 Paper bank
144 Paper feeding cassette
145 Separating roller
146 Paper feeding path
147 Transfer roller
148 Paper feeding path
150 Copying device main body
160 Charging device
200 Paper feeding table
300 Scanner
400 Automatic document feeder
P Image receiving paper
T Toner
C Core
S Shell

The invention claimed is:

1. A toner comprising:
a binder resin; and
a colorant,
wherein
the toner has a core-shell structure comprising a core and a shell,
the binder resin comprises a crystalline polyester resin and a non-crystalline polyester resin,
a ratio of a mass of the crystalline polyester resin to a mass of the non-crystalline polyester resin is from 5/95 to 75/25, and
a ratio of a hardness of the shell to a hardness of the core is from 1.05 to 1.50, wherein the hardnesses are measured with a scanning probe microscope.

2. The toner according to claim 1, wherein the shell has an average thickness of from 0.01 μm to 0.5 μm.

3. The toner according to claim 1, wherein the ratio of the hardness of the shell to the hardness of the core is from 1.05 to 1.15.

4. The toner according to claim 1, wherein the toner is obtained through granulation performed by a process comprising dispersing, in an aqueous medium, an oil phase comprising the crystalline polyester resin, the non-crystalline polyester resin and the colorant.

5. The toner according to claim 4, wherein the granulation in the aqueous medium is performed by a process comprising:
dispersing or dissolving, in an organic solvent, an active hydrogen group-containing compound, a polyester resin comprising a functional group reactive with the active hydrogen group-containing compound, the crystalline polyester resin, the non-crystalline polyester resin and the colorant, to prepare a dissolved or dispersed product;
dispersing the dissolved or dispersed product in the aqueous medium comprising fine resin particles, to prepare a first dispersion liquid;
allowing, in the first dispersion liquid, the active compound and the polyester resin to undergo crosslinking reaction, elongating reaction, or both, in the presence of the fine resin particles, to prepare a second dispersion liquid; and
removing the organic solvent from the second dispersion liquid.

6. An image forming apparatus comprising:
a latent electrostatic image bearing member;
a latent electrostatic image forming unit configured to form a latent electrostatic image on the latent electrostatic image bearing member;
a developing unit containing the toner according to claim 1, and configured to develop the latent electrostatic image with the toner to form a visible image;
a transfer unit configured to transfer the visible image onto a recording medium; and
a fixing unit configured to fix the transferred visible image on the recording medium.

7. The image forming apparatus according to claim 6, further comprising a process cartridge detachably mounted to a main body of the image forming apparatus, wherein the process cartridge integrally supports the latent electrostatic image bearing member and the developing unit.

8. The image forming apparatus according to claim 6, wherein the shell has an average thickness of from 0.01 μm to 0.5 μm.

9. The image forming apparatus according to claim 6, wherein the ratio of the hardness of the shell to the hardness of the core is from 1.05 to 1.15.

10. The image forming apparatus according to claim 6, wherein the toner is obtained through granulation performed by a process comprising dispersing, in an aqueous medium, an oil phase comprising the crystalline polyester resin, the non-crystalline polyester resin, and the colorant.

11. The image forming apparatus according to claim 10, wherein the granulation in the aqueous medium is performed by a process comprising:
dispersing or dissolving, in an organic solvent, an active hydrogen group-containing compound, a polyester resin comprising a functional group reactive with the active hydrogen group-containing compound, the crystalline polyester resin, the non-crystalline polyester resin and the colorant, to prepare a dissolved or dispersed product;
dispersing the dissolved or dispersed product in the aqueous medium comprising fine resin particles, to prepare a first dispersion liquid;
allowing, in the first dispersion liquid, the active compound and the polyester resin to undergo crosslinking reaction, elongating reaction, or both, in the presence of the fine resin particles, to prepare a second dispersion liquid; and
removing the organic solvent from the second dispersion liquid.

12. An image forming method comprising:
forming a latent electrostatic image on a latent electrostatic image bearing member;
developing the latent electrostatic image with a toner to form a visible image;
transferring the visible image onto a recording medium; and
fixing the transferred visible image on the recording medium,
wherein the toner comprises:
a binder resin; and
a colorant,
wherein
the toner has a core-shell structure comprising a core and a shell,
the binder resin comprises a crystalline polyester resin and a non-crystalline polyester resin,
a ratio of a mass of the crystalline polyester resin to a mass of the noncrystalline polyester resin is from 5/95 to 75/25, and a ratio of a hardness of the shell to a hardness of the core is from 1.05 to 1.50, wherein the hardnesses are measured with a scanning probe microscope.

13. The image forming method according to claim 12, wherein the fixing comprises heating and fixing the transferred visible image on the recording medium with a fixing unit comprising a heat generator, a heat transfer media heated by the heat generator, and a press member for pressing the recording medium against the heat transfer media, wherein the heat transfer media is a belt-shaped heat transfer medium, and with the belt-shaped heat transfer medium, a certain amount of oil is applied on a surface thereof or no oil is applied on the surface thereof.

14. The image forming method according to claim 12, wherein a surface pressure in the fixing is from 10 $N/cm^2$ to 80 $N/cm^2$.

15. The image forming method according to claim 12, wherein the shell has an average thickness of from 0.01 μm to 0.5 μm.

16. The image forming method according to claim 12, wherein the ratio of the hardness of the shell to the hardness of the core is from 1.05 to 1.15.

17. The image forming method according to claim 12, wherein the toner is obtained through granulation performed by a process comprising dispersing, in an aqueous medium, an oil phase comprising the crystalline polyester resin, the non-crystalline polyester resin, and the colorant.

* * * * *